United States Patent [19]

Orr et al.

[11] 4,236,292

[45] Dec. 2, 1980

[54] METHOD OF POSITIONING, GAPPING AND APPLYING STOP TO SLIDE FASTENER

[75] Inventors: David A. Orr; Hiren S. Gala, both of Erie; George J. Scagnelli, Meadville, all of Pa.

[73] Assignee: Textron Inc., Providence, R.I.

[21] Appl. No.: 909,863

[22] Filed: May 26, 1978

[51] Int. Cl.[3] ..... B29D 5/00

[52] U.S. Cl. ..... 29/408

[58] Field of Search ..... 29/408, 410, 766, 767, 29/770

[56] References Cited

U.S. PATENT DOCUMENTS

| | | | |
|---|---|---|---|
| 2,885,774 | 5/1959 | Waldes | 29/408 |
| 3,485,691 | 12/1969 | Waldes | 29/408 X |
| 3,639,969 | 2/1972 | Potin | 29/408 |
| 3,689,980 | 9/1972 | Oyama | 29/408 |
| 3,863,323 | 2/1975 | Takamatsu | 29/408 |
| 3,872,571 | 3/1975 | Douri | 29/408 |
| 4,110,890 | 9/1978 | Akashi | 29/408 |

*Primary Examiner*—Ervin M. Combs

*Attorney, Agent, or Firm*—O'Brien & Marks

[57] ABSTRACT

A positioning member is moved transverse to a slide fastener chain after advancement of the slide fastener chain to a gapping and stop applying station to position fastening elements of the slide fastener chain in a channel extending in the station. The slide fastener chain is clamped and gapped, and a bottom stop is applied to the chain.

5 Claims, 25 Drawing Figures

FIG. 1
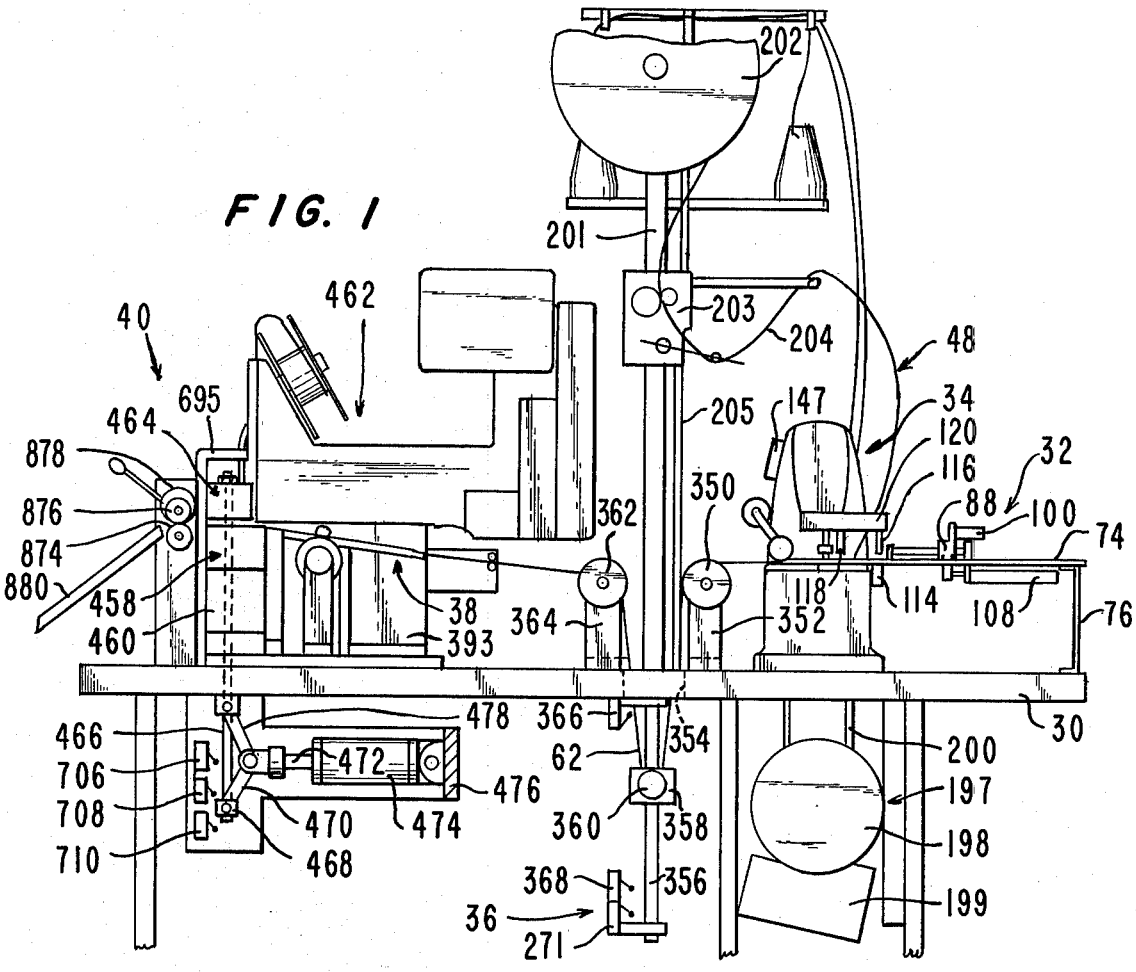
FIG. 2
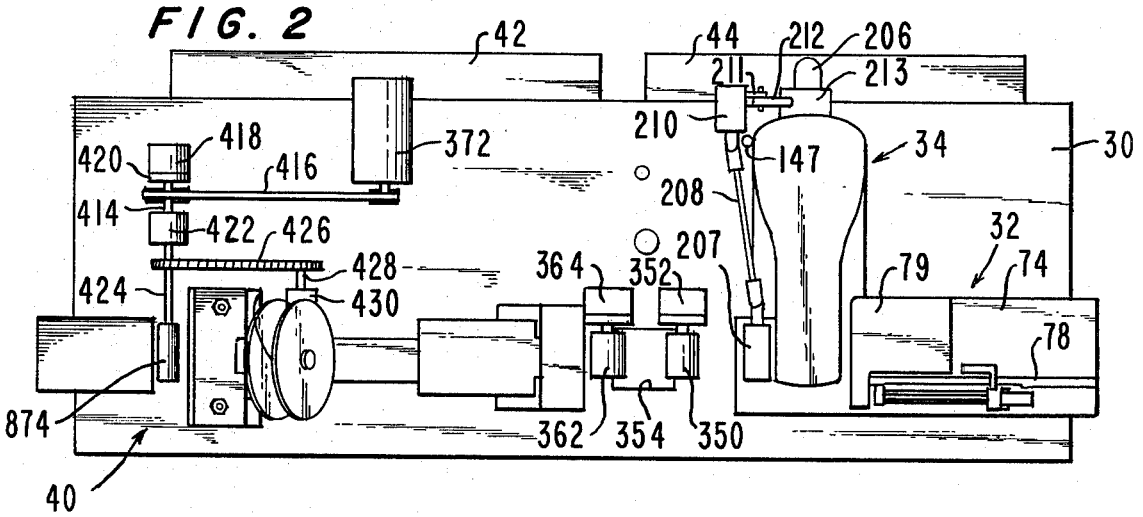
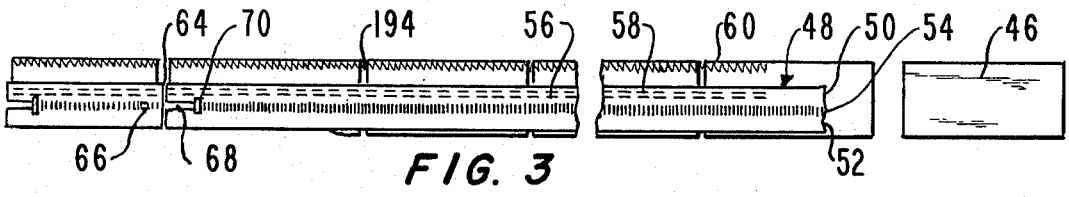
FIG. 3

32
34
46
48
74
78
80
82
84
86
88
90
92
94
96
97
98
100
102
104
106
108
110
112
116
118
120
121
156

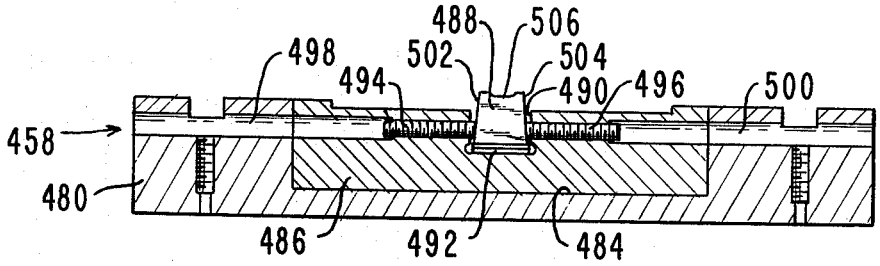
FIG. 18
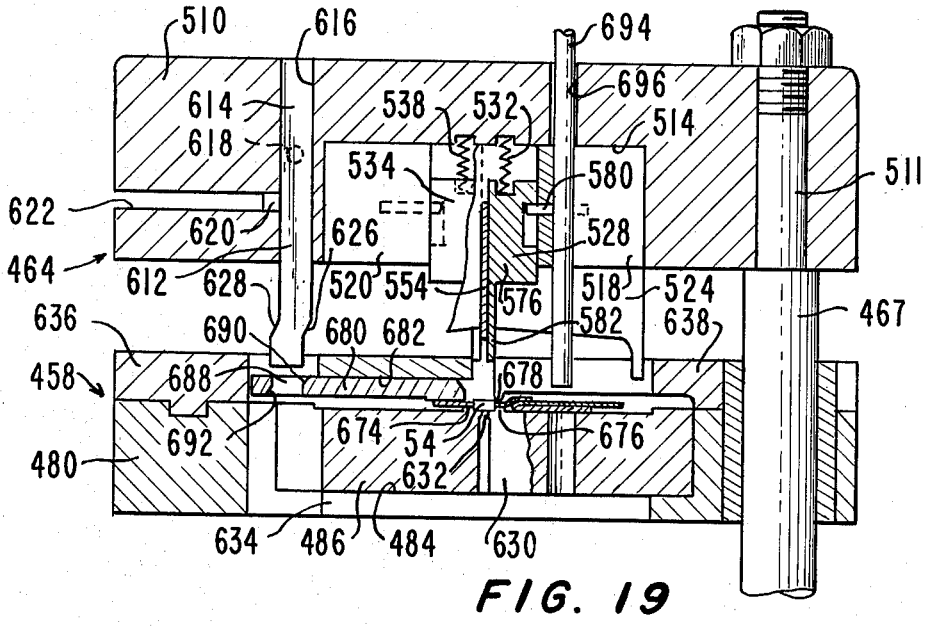
FIG. 19
FIG. 20
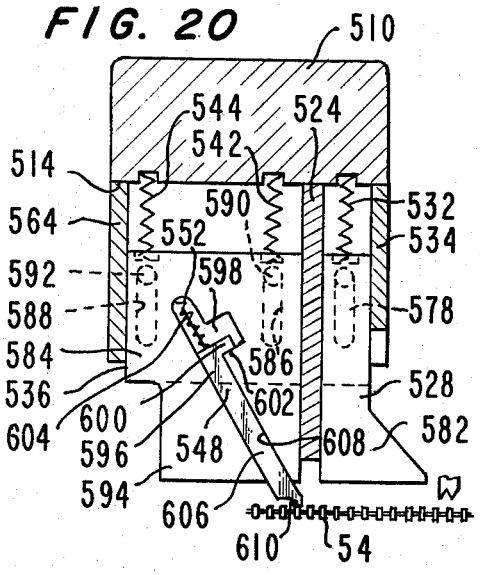
FIG. 21
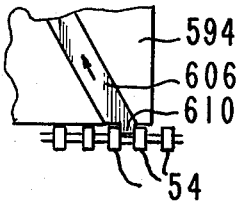
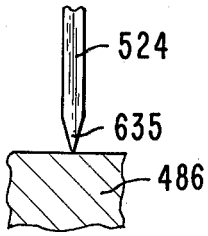
FIG. 22

METHOD OF POSITIONING, GAPPING AND APPLYING STOP TO SLIDE FASTENER

BACKGROUND OF THE INVENTION

1. Field of the Invention

This invention relates to methods and apparatus for producing articles such as slide fastener flypiece units for trousers.

2. Description of the Prior Art

The prior art as exemplified in U.S. Pat. Nos. 2,697,227, 2,731,643, 3,263,238, 3,570,104 and 3,765,348 contains a number of methods and apparatus for producing trouser fly slide fastener units and the like. These prior art apparatus are characterized by one or more deficiencies such as requiring several operators, occupying an excessive amount of floor space, being inefficient in performing the steps of manufacture, being slow in performing the fly slide fastener unit manufacture, etc.

The prior art also contains a number of sewing apparatus, such as U.S. Pat. Nos. 498,616, 2,973,732 and 2,884,883 some of which have multiple presser foot shafts, both serge and sew straight lines, or sew multiple lines of stitches.

U.S. Pat. Nos. 2,272,408, 2,685,664, 2,705,466 and 3,329,113 disclose sensors and cutting apparatus operated by sensors in sewing operations.

U.S. Pat. Nos. 2,885,774 and 3,831,474 disclose gapping mechanisms for removing coupling elements from selected portions of continuous slide fastener chains.

SUMMARY OF THE INVENTION

The invention is summarized in a method of gapping and applying a bottom stop to a section of a slide fastener chain including advancing the section of slide fastener chain into a common base assembly extending beneath both a bottom stop applying machine and a gapping punch assembly which is adjacent to the bottom stop applying machine, lowering the gapping punch assembly, positioning and clamping the section of slide fastener chain in the base assembly underneath the gapping punch assembly during the lowering of the gapping punch assembly so as to also position and hold the slide fastener chain with respect to the bottom stop applying machine, gapping the slide fastener chain by engaging a gapping punch in the gapping punch assembly with a selected number of fastening elements in the section of slide fastener chain during the lowering of the punch assemby but after the positioning and clamping of the section of slide fastener chain, and applying a bottom stop to the section of slide fastener chain after the positioning and clamping of the section of slide fastener chain.

An object of the invention is to provide a new and improved method and apparatus for producing slide fastener units such as trouser fly units with attached slide fasteners.

Another object of the invention is to substantially reduce requirements for labor in forming slide fastener units as well as to increase production speed in producing such units.

It is still another object of the invention to reduce the amount of floor space occupied by slide fastener unit forming apparatus.

An advantage of the invention is that operations previously done separately are now done in a single operation thus reducing the amount of skilled operator time.

One feature of the invention relates to the combination of bottom stop applying, gapping, and cutting a slide fastener chain in a combined operation at a single station.

Another feature of the invention is the utilization of common positioning members for positioning and holding a slide fastener chain for both gapping and applying a bottom stop.

A further feature of the invention is the provision of a movable guide plate within a gapping section for permitting a bottom stop to pass through the gapping section.

One additional feature of the invention relates to an improved flypiece feeding mechanism wherein flypieces positioned on a guide member against a stop are automatically gripped and advanced to a sewing machine when the sewing of the previous flypiece has been completed.

Still another feature of the invention relates to a folder for folding a flypiece away from a slide fastener chain wherein the slide fastener chain is bent prior to the chain entering a guide channel in the folder and the end of the flypiece extending from the bent chain is caught and folded away from the chain.

Yet still another feature of the invention concerns the inclusion of a separate shaft with adjustable spring bias engaging the top of a presser foot plate spaced from the normal presser foot mounting shaft in the sewing machine to eliminate skew and uneven feed of the flypiece and slide fastener chain through the sewing machine.

Other objects, advantages and features of the invention will be apparent from the following description of the preferred embodiment taken in conjunction with the accompanying drawings.

BRIEF DESCRIPTION OF THE DRAWINGS

FIG. 1 is an elevation view taken from the left side of an apparatus for forming trouser fly closure units in accordance with the invention.

FIG. 2 is a plan view of the apparatus of FIG. 1.

FIG. 3 is a plan view of a trouser flypiece and slide fastener chain being formed into a trouser fly unit by the apparatus of FIG. 1.

FIG. 18 is a cross section view taken through an anvil portion of the common base shown in FIG. 17.

FIG. 19 is a cross section view taken along an angle from the middle right toward the left rear of the gapping and cutting mechanism as well as the common base mechanism in FIG. 17.

FIG. 20 is a side cross section view taken from the left of pressure pads as well as an element positioning member in the gapping mechanism of FIGS. 17 and 19.

FIG. 21 is a view taken similar to that in FIG. 20 but of a broken away portion of the mechanism of FIG. 20 particularly illustrating a further step in the operation of the slide fastener element positioning member, FIG. 22 is a side cross section view of a modified tape cutting blade of the gapping and cutting mechanism and a die portion of the common base for use in a modified apparatus for forming trouser fly closure units in accordance with the invention.

DESCRIPTION OF THE PREFERRED EMBODIMENT

General Description

Figures 4, 5:
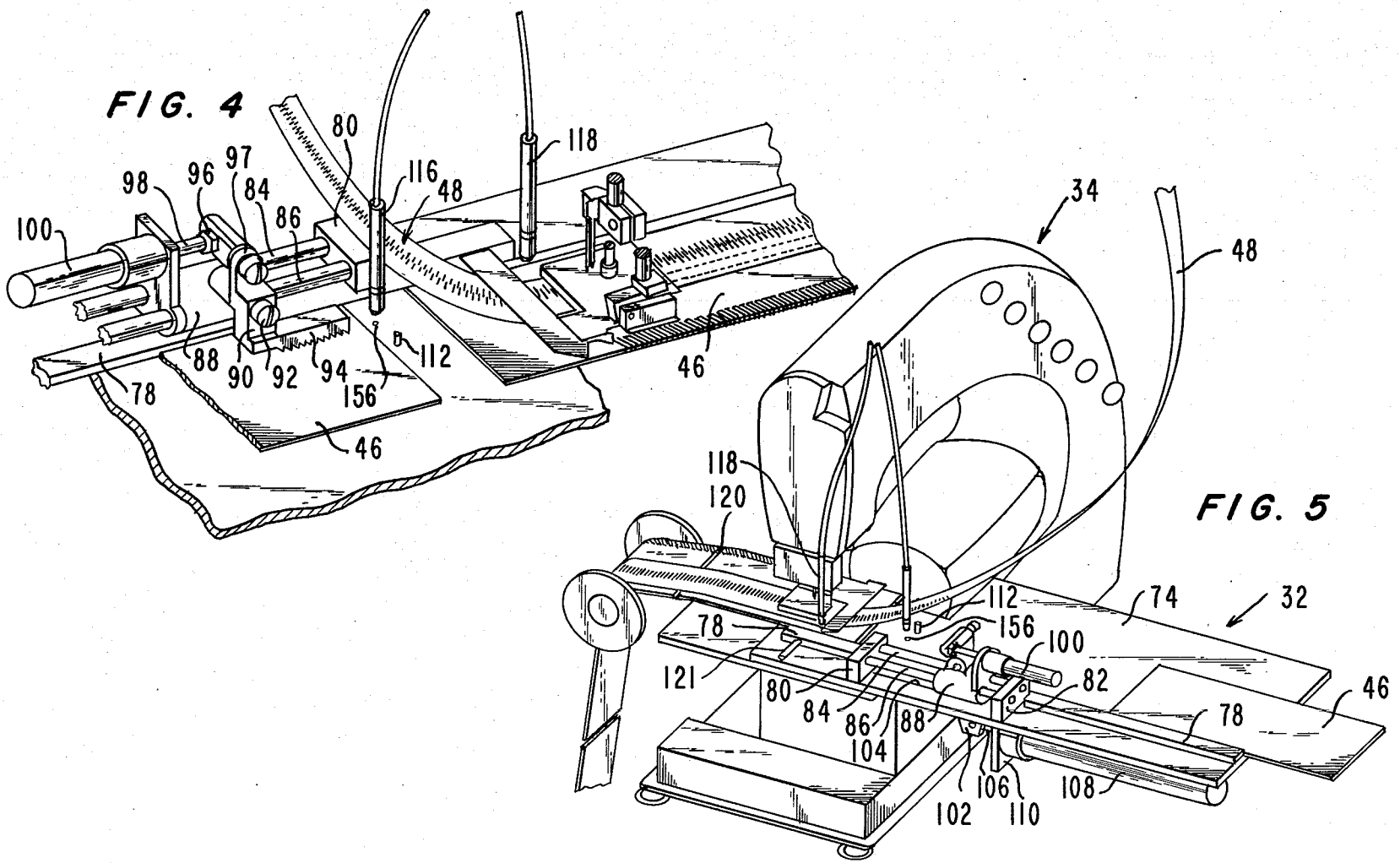
FIG. 4 is a perspective view taken from the upper right front corner of a flypiece feeding mechanism in the apparatus of FIGS. 1 and 2.
FIG. 5 is a perspective view taken from the upper left hand corner of a sewing machine and feeding mechanism in the apparatus of FIGS. 1 and 2.

As illustrated in FIGS. 1 and 2, an apparatus for manufacturing slide fastener units in accordance with the invention includes a table or frame 30 supporting a flypiece feeding mechanism indicated generally at 32, a sewing machine or mechanism indicated generally at 34, a loop control mechanism indicated generally at 36, a folder and feeding mechanism indicated generally at 38, and a bottom stop applying, gapping and cutting mechanism indicated generally at 40. Boxes 42 and 44 mounted on the table 40 contain electrical control circuitry for controlling the apparatus.

The front of the apparatus is shown at the right in FIGS. 1 and 2, the rear of the apparatus is shown at the left, the left side of the apparatus is shown at the bottom in FIG. 2, and the right side of the apparatus is shown at the top in FIG. 2.

The flypiece feeding mechanism 32 at the front of the apparatus receives cloth flypieces 46, shown in FIG. 3, and automatically feeds the flypieces 46 to the sewing machine 34. A slide fastener chain indicated generally at 48 and consisting of textile tapes 50 and 52 with interengaging coupling elements 54 mounted on the inner edges of the tapes 50 and 52 is directed to the sewing machine 34 over the flypieces 46. The sewing machine 34 sews the tape 50 of the slide fastener chain 48 to the flypiece 46 such as by two lines of straight stitches 56 and 58. Additionally the sewing machine 34 serges or forms an overedge stitching 60 on the right side edge of the flypiece simultaneously with the forming of the stitches 56 and 58. The loop control mechanism 36 provides for differences in the speed of operation of the sewing machine 34 and the bottom stop applying, gapping and cutting mechanism 40 by maintaining a loop 62 in the continuous slide fastener chain 48 with attached flypiece 46 within upper and lower limits between the sewing machine 34 and the folding and feeding mechanism 38. In the event either the sewing machine 34 or the bottom stop applying, gapping and cutting mechanism 40 stops, the loop control mechanism 36 prevents the loop 62 from becoming too short or too long by stopping operation of the other mechanism 34 or 40. The folding and feeding mechanism 38 folds the left side of the fly piece 46 underneath the right side thereof so as to expose the coupling elements 54 on both the top and bottom of the slide fastener chain 48 and feeds the chain with folded flypiece to the bottom stop applying, gapping and cutting mechanism 40 under the control of the mechanism 40. The slide fastener chain 48 is cut at 64 and two pluralities of the interengaging coupling elements at 66 and 68 are removed from the slide fastener chain by the mechanism 40. Simultaneously therewith a bottom stop 70 is applied to secure the tapes 50 and 52 together at the bottom end of the slide fastener chain also by the mechanism 40.

Flypiece Feeding Mechanism

The flypiece feeding mechanism 32 as shown in FIGS. 1, 2, 4 and 5 includes a plate 74 mounted at the rear end thereof on the sewing machine 32 and extending in front of the sewing area of the sewing machine 34 over the front edge of the table 30 where the plate 74 is supported by a bracket 76. A guide bar 78 is mounted on the plate 74 and has a straight edge on its right side for guiding a flypiece 46 placed on the plate 74 in alignment with the sewing area of the sewing machine 34. A clear plastic guard 79 is mounted above the plate 74 at the front of the sewing machine 34 and is spaced to permit feeding of flypiece to the sewing machine but to prevent the fingers of an operator from being inadvertently pushed into the sewing mechanism. A pair of spaced support blocks 80 and 82 are also mounted on top of the plate 74 and support parallel rods 84 and 86 which slidably support a carriage 88 for sliding movement parallel to the bar 78. A clamp member 90 is pivotally mounted on the carriage 88 and 92 and has a lower extending tooth portion 94 for gripping the flypiece 46 against the plate 74 and has an upper lever end portion connected by a pivot member 96 to a piston rod 98 extending from an air cylinder 100 mounted on the carriage 88 for pivoting the clamp member 90. A tongue 102 on the carriage 88 extends downward through a slot 104 in the plate 74 and is connected to a piston rod 106 of an air cylinder 108 mounted on a bracket 110 on the underside of the plate 74 for advancing and retracting the carriage 88. The block 80 is adjustably mounted, for example by bolt means (not shown) in the slot 104, to form an adjustable stop for forward movement (i.e., from front to rear) of the carriage 88. The air cylinders 100 and 108 are double acting air cylinders. A stop member 112 is mounted on a piston rod of a single acting air cylinder 114, FIG. 1, having conventional spring means (not shown) biasing the piston rod and stop member 112 to a retracted position below the top of the plate 74. The input of the stop air cylinder 114 is connected in common with the retract input of the clamp air cylinder 100. The air cylinder 114 is mounted underneath the plate 74 with the stop 112 extending upward so as to extend into the path of flypieces 46 in front of the sewing area of the sewing machine 34 when the air cylinder 114 is activated.

A pair of flypiece sensing devices, such as combination light emitting diode and light sensitive diode sensors 116 and 118 model No. S322-3 from SCAN-A-MATIC, Elbridge, N.Y., are mounted by a bracket 120, FIG. 1, on the sewing machine 34. The sensor 116 is positioned adjacent to the stop 112 for sensing the presence of the leading edge of a flypiece 46 abutting the stop 112 while the sensor 118 is positioned adjacent the sewing area of the sewing machine 34 to one side of the slide fastener chain 48 for sensing the presence of a flypiece 46 in the sewing area. Air jet means 121, FIG. 5, is formed in the guide 78 for maintaining the bottom of the sensor 118 free of lint.

Figure 23:
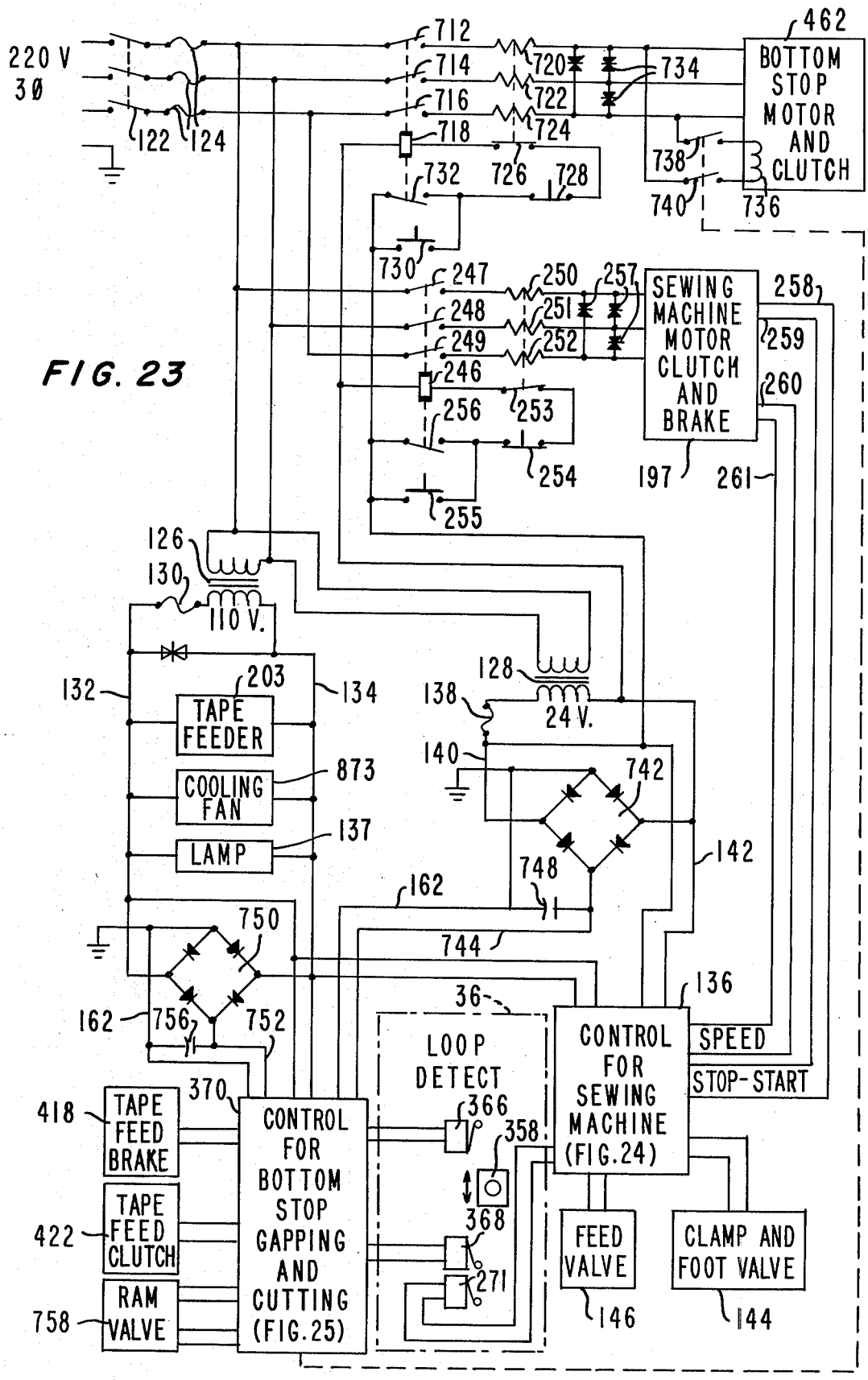
FIG. 23 is a electrical diagram of the electrical circuitry for operating the apparatus of FIGS. 1 and 2.

As shown in FIG. 23, three-phase alternating current power is connected through power switch 122 and fuses 124 to three lines, two of which are connected in parallel across primary windings of voltage step down transformers 126 and 128. The secondary winding of the transformer 126 is connected in series with a fuse 130 to lines 132 and 134 which are connected to first inputs of a control circuit 136 while the secondary winding of the voltage transformer 128 is connected in series with a fuse 138 to lines 140 and 142 which are connected to second inputs of the control circuit 136. The three phase power input may be, for example, 220 volts while the output of the transformer 126 is 110 volts and the output of the transformer 128 is 24 volts. Electrically operated four-way air valves 144 and 146 are connected to the control circuit 136. The valve 144 controls the clamp air cylinder 100 (FIGS. 1 and 5), the stop air cylinder 114 and a double-acting presser-foot air cylinder 147 while the valve 146 controls the feed air cylinder 108. A lamp 137 (FIG. 23) connected to lines 132 and 134 is positioned to illuminate the plate 74.

Figure 24:
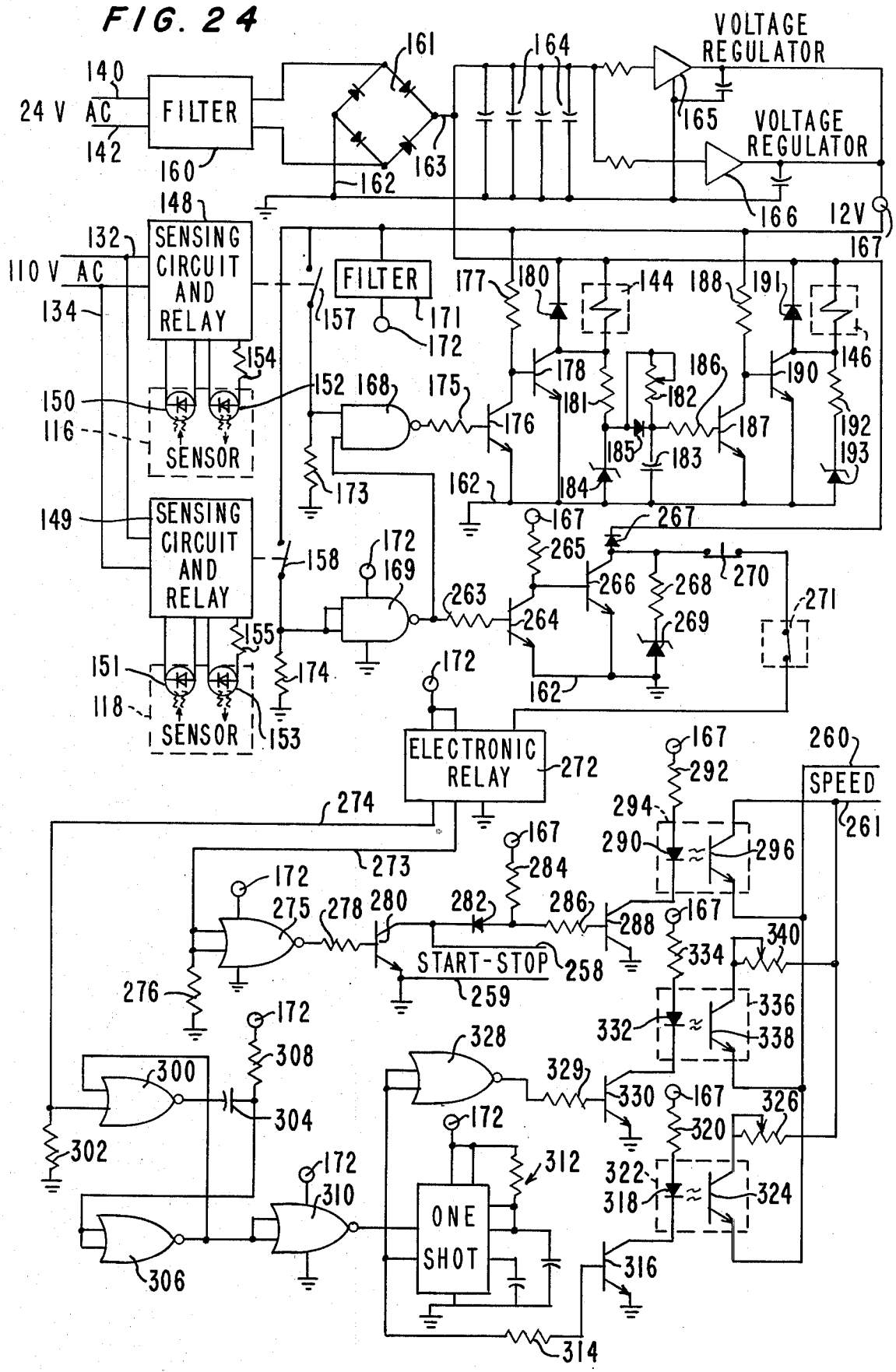
FIG. 24 is a detailed electrical diagram of one control circuit portion of the circuitry of FIG. 23.

The control circuit 136 as shown in FIG. 24 includes a pair of sensing and relay circuit units 148 and 149 which are energized by power on lines 132 and 134 and which are controlled by the respective light sensitive diodes or photodiodes 150 and 151 and the respective light emitting diodes 152 and 153 of sensors 116 and 118. The circuits 148 and 149 each may be formed, for example, from combined circuit units model No. PAN-2, No. PAN-102 and No. PAN-201 from Fork Standard Inc., 211 Main St. West, Chicago, Ill. The sensing circuits 148 and 149 have means for applying a signal of a selected frequency, for example 2000 hertz, to the light emitting diodes 152 and 153 and have detecting means for eliminating all signals except this particular frequency component in the signal from the light sensitive diodes 150 and 151 to thus prevent response of the sensing circuits to background or room illumination. Protective resistors 154 and 155 are connected in series with the respective light emitting diodes 152 and 153 of the sensors 116 and 118. Holes (only one hole 156 shown in FIGS. 4 and 5) are formed in the plate 74 below the respective sensors 116 and 118 to provide for a greater contrast between reflected light sensed by the light sensor diodes 152 and 153 of the sensors 116 and 118 when flypieces 46 are positioned underneath the sensors and reflected light when there is an absence of flypieces positioned underneath the sensors 116 and 118. The sensing circuits 148 and 149 have means such as a potentiometer (not shown) to control the sensitivity and are set to close respective normally open relay contacts 157 and 158 of the circuits 148 and 149 when reflected light indicates the presence of flypieces beneath the respective sensors 116 and 118.

A filter circuit 160 is connected across lines 140 and 142 to eliminate spurious signals and high frequency components. The output of the filter 160 is connected across input terminals of a bridge rectifier circuit 161 which has its output connected to lines 162 and 163 across parallel filter capacitors 164 of varying size to filter the rectified output of the bridge rectifier circuit 161. A pair of conventional voltage regulator circuits 165 and 166 are connected in parallel to the lines 162 and 163 and have outputs commonly joined to a terminal 167 to produce a regulated direct current voltage output, for example a 12-volt voltage.

The contacts 157 of the sensing circuit 148 are connected between the terminal 167 and one input of a nandgate 168 while the contacts 158 of the sensing circuit 149 are connected between the terinal 167 and both inputs of a nand gate 168 while the contacts 158 of the sensing circuit 149 are connected between the terminal 167 and both inputs of a nand gate 169. A filter circuit 171 is connected between the terminal 167 and a terminal 172 which is connected to a power input of an intergrated circuit unit including both nand gates 167 and 168. The one input of the nand gate 168 and both inputs of the nand gate 169 are connected by respective biasing resistors 173 and 174 to ground potential, i.e. line 162. The output of nand gate 169 is connected to the other input of nand gate 168 which has its output connected through an input resistor 175 to the base of NPN transistor 176 having its emitter connected to the ground 162. The collector of the transistor 176 is connected to one end of a load resistance 177 which has its other end connected to the terminal 167. The collector of the transistor 176 is also connected to the base of a NPN transistor 178 having an emitter connected to the ground 162 and having a collector connected in series with the solenoid of the valve 144 to line 163; the valve 144 has a spring return (not shown). A diode 180 is connected across the solenoid of the valve 144 to provide a circuit path for inductive voltage when the solenoid is deenergized. A resistance 181 is connected in series with a variable resistance 182 and a capacitor 183 across the collector-emitter of the transistor 178 to form a delay circuit having a delay determined by values of the resistances 181 and 182 and the capacitor 183. A zenor diode 184 has an anode connected to ground and has a cathode connected to the junction between the resistances 181 and 182 for limiting positive voltage across the capacitance 103. A bypass diode 185 has an anode connected to the junction of the resistances 181 and 182 and has a cathode connected to the other end of the resistance 182 for reducing the delay in charging the capacitor 183 with a positive voltage. The junction of the resistance 182 with the capacitor 183 is connected by an input resistance 186 to the base of a NPN transistor 187 which has an emitter connected to ground 162 and which has a collector connected to one end of a load resistance 188 joined at its other end to the voltage terminal 167. The collector of the transistor 187 is also connected to a base of a NPN transistor 190 which has its emitter joined to ground 162. A solenoid of the valve 146 is connected between the collector of transistor 190 and the line 163; a spring return (not shown) is included in the valve 146. A protective diode 191 is connected across the solenoid of valve 146 to provide a bypass circuit for inductive current generated when the solenoid of valve 146 is deenergized. A series circuit of a resistance 192 and a zener diode 193, the anode of the diode 193 connected to ground 164, is connected across the collector-emitter of the transistor 190 to further aid in preventing excessive voltages across the transistor 190.

In operation of the flypiece feeding mechanism 32 of FIGS. 1, 2, 4, 5, 23, and 24 beginning initially with an absence of fly-pieces 46 underneath both sensors 116 and 118, the relay contacts 157 and 158 (FIG. 24) are open rendering one input of nand gate 168 at ground potential to produce a positive output thereon. This positive output on gate 176 renders transistor 176 conductive which in turn renders transistors 178 nonconductive maintaining the solenoid of valve 144 unenergized. Also the transistor 187 is rendered conductive by positive voltage from the collector of transistor 178 to hold transistor 190 non-conductive and thus maintain the solenoid of valve 146 unenergized. With the solenoid of valves 144 and 146 unenergized the spring returns of such valves maintain the valves so that the air pressure is applied to the retract inputs of the air cylinders 100 and 108, FIG. 5, as well as to the stop air cylinder input 114, FIG. 1; thus the carriage 88 is retracted toward the front of the apparatus, the clamp member 90 is pivoted to hold the lower flypiece gripping portion 94 in a raised position, and the stop member 112 is held in a raised position.

Manual advancement of a flypiece 46 on the plate 74 along the guide bar 78 against the raised stop 112 is sensed by the sensor 116 which operates the sensing circuit 148 (FIG. 24) to close contacts 157 and produce a positive voltage on the one input of the nand gate 168. The other input of the gate 168 is positive due to the contacts 158 being open and the inputs of nand gate 169 being biased to ground to produce a positive output applied to the other input of gate 168. The output of nand gate 168 goes to zero or ground when both of its inputs are positive rendering the transistor 176 non-conductive which in turn renders transistor 178 conductive to complete a circuit path through the solenoid of valve 144 and thus operate the valve 144. With valve 144 operated, air is applied to the advance input of the air cylinder 100 to pivot the clamp member 90 and engage the flypiece engaging portion 94 with the flypiece 46. Also the four-way valve 144, when operated, exhausts the retract input to air cylinder 100 as well as exhausting the input to air cylinder 114 which permits the spring return of air cylinder 114 to retract the stop 112 below the top surface of plate 74. After a delay determined by the values of resistances 181, 182 and 186 and the capacitor 183, the capacitor 183 is discharged sufficiently to render the transistor 187 non-conductive which in turn renders transistor 190 conductive completing a circuit path through the solenoid of the air valve 146. This operates valve 146 to exhaust the retract input of the air cylinder 108 and apply air pressure to the advance input of air cylinder 108 to move the carriage 88 to the stop 80 and slide the flypiece 46 on top of the plate 74 toward the sewing station of the sewing machine 34.

When the leading edge of the flypiece 46 is sensed by the sensor 118, contacts 158 of sensing circuit 149 are closed rendering the inputs of nand gate 169 positive producing a zero output thereof applied to nand gate 168 rendering the output of gate 168 positive. This causes transistor 176 to become conductive rendering transistor 178 non-conductive to de-energize the solenoid of valve 144 which due to its spring return applies air pressure to the retract input of air cylinder 100 and exhausts the advance input of the air cylinder 100 to retract the piston rod 98 and pivot the clamp member 90 raising the cloth engaging portion 94. The valve 144 also applies air pressure to air cylinder 144 to raise the stop 112 into position for the next flypiece to be positioned on the plate 74; the trailing edge of the flypiece 146 will freely pass over the stop 112 after the stop has been raised. Again after a delay determined by the values of the resistance 181 and the capacitance 183, the transistor 187 is rendered conductive by an increase in voltage across the capacitance 187 to render transistor 190 non-conductive deenergizing the solenoid of valve 146. This valve 146 causes the air cylinder 108 to retract the piston rod 106 and the carriage 88 toward the front of the apparatus.

The next flypiece 46 can be positioned against the stop 112 as the preceding flypiece is being sewn by the sewing machine 34. Until the trailing edge of the preceding flypiece passes the sensor 118, the contacts 158 of sensing circuit 149 remain closed to hold the inputs of nand gate 169 positive which results in the output of nand gate 168 being held positive to maintain the solenoids of valves 144 and 146 unenergized. Once the trailing edge passes the sensor 118, contacts 158 open to permit operation of nand gate 168 and the valves 144 and 146 to feed the next flypiece. The spacing of the leading end of the next flypiece from the trailing end of the preceding flypiece is determined by the position of the stop or support block 80 to produce a predetermined gap 194, FIG. 31 between flypieces.

The flypiece feeding mechanism 32 produces rapid feeding and uniform spacing between the flypieces 46 regardless of the length of the flypieces. The automatic feeding of flypieces from the stop 112 to the sewing station of the sewing machine 34 by the sliding carraige 88 and pivoted gripping member 90 is substantially faster and more reliable than manual feeding; this permits manufacture of more flypiece slide fastener assemblies per unit of time. The width of the gaps 194 is accurately set between the flypieces at a minimum spacing to avoid excessive lengths of slide fastener chain between flypieces and thus reduce costs.

Sewing Machine

The sewing machine 34 of FIGS. 1 and 2 is a conventional sewing machine which has been modified. One particular suitable type of sewing machine is Union Special Corporation Model No. 52300F. The sewing machine 34 also includes a motor unit generally indicated at 197 and having a motor 198 such as Teledyne Amco Vario-stop Motor Type No. VD 12, with a conventional control circuit 199, such as type S-3A7 by the same manufacture as the motor. The motor 198 and control unit 199 are mounted on the table 30 and drive the sewing machine by means of a belt 200. There is also provided conventional mechanism for feeding the slide fastener chain 48, such as a stand 201 mounted on the table 30 for supporting a reel 202 of the chain 48 and for supporting a conventional automatic feeder 203 which maintains sufficient slack or a loop 204 in the chain 48 to prevent tension in the chain 48 delivered in the sewing machine 34. Also a stand 205 for holding thread bobbins and for guiding the threads to the sewing machine 34 is mounted on the table 30. A conventional zero position sensor 206 supplied with the motor 198 and control 199 is connected to the shaft of the sewing machine 34 to control the stopping of the sewing machine in the exact up position of the needles of the sewing machine or the exact down position of the needles of the sewing machine. Further a conventional pull off wheel 207 is driven through a universal joint on one end of a shaft 208 which has its other end connected by a universal joint to a ratchet drive 210 having an arm 211 which is oscillated by an adjustable pivot on an arm 212 of an eccentric 213 mounted on the shaft of the sewing machine 34 to pull the assembled slide fastener chain 48 and attached fly-pieces 46 from the sewing station of the sewing machine 34.

The sewing machine 34 was originally formed with two needles carried by the reciprocating needle bar, one looper for cooperating with one of the needles to form a straight line of double thread chain stitches, and a conventional overedge stitch forming mechanism cooperating with the other needle for forming two thread overedge stitching. Modifications made to the sewing machine 34 include the addition of a third needle and a second looper for forming a second straight line of double thread chain stitches as well as the displacement of the needles and loopers forming the straight lines of stitches at a greater distance from the overedge stitch mechanism.

Figure 6:
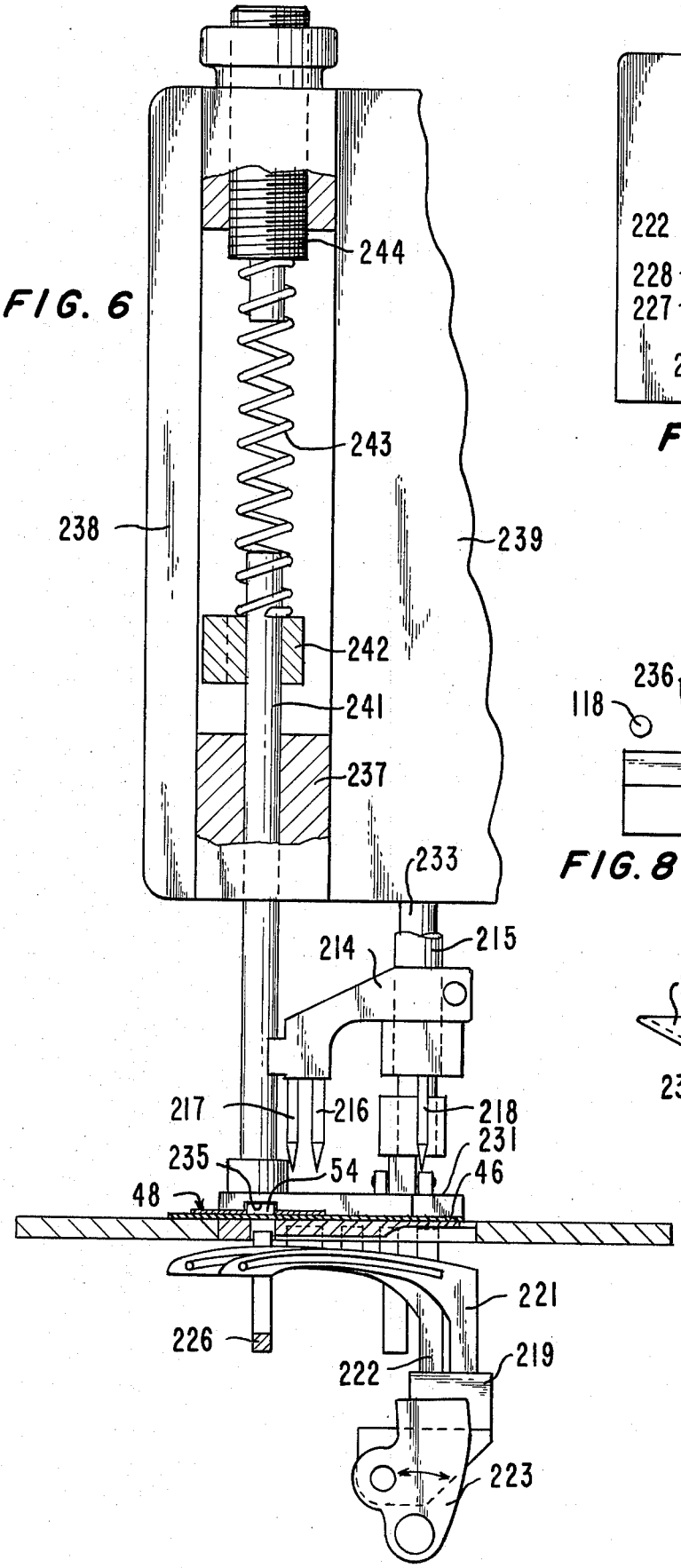
FIG. 6 is a front view partially in cross section of a broken away portion of the sewing machine of the apparatus of FIGS. 1 and 2.

As shown in FIG. 6, a needle holder 214 is mounted on the reciprocating needle shaft 215 of the sewing machine and holds a pair of spaced needles 216 and 217 at a selected distance to the left of the overedge needle 218 of the sewing machine. A looper holder 219, see also FIG. 10, attaches two spaced loopers 221 and 222 to the looper rocker 223 of the sewing machine. The loopers 221 and 222 and the needles 216 and 217 are positioned so as to cooperate with each other to form two straight stitching lines each being a two thread chain stitch. The conventional overedge stitching mechanism which cooperates with the overedge stitching needle 218 remains substantially unchanged as well as the edge trimmer normally employed with such overedge stitching mechanism.

Figure 7:
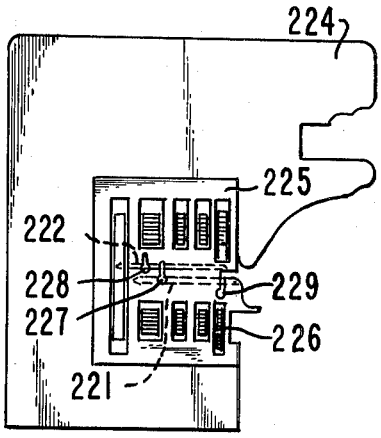
FIG. 7 is a plan view of a cloth feeding plate and feed dog arrangement of the sewing machine mechanism shown in FIGS. 5 and 6.
Figure 10:
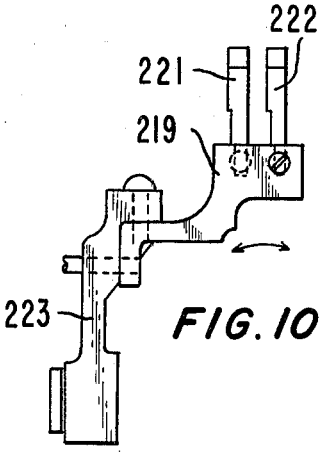
FIG. 10 is a side view taken from the right of a looper modification in the sewing mechanism of FIG. 6.

In FIG. 7 there is illustrated a cloth plate 224, feeder plate 225 and top portion of a feeder 226 extending into openings in the feeder plate 225. Also the feeder plate 225 contains needle openings 227, 228 and 229 for receiving the respective needles 216, 217 and 218. The needle 217 in addition to being spaced to the left of the needle 216 is also spaced to the rear of the needle 216 as shown by the needle openings 227 and 228. The loopers 221 and 222 are spaced in a similar manner as shown in FIGS. 6 and 10.

Figure 8:
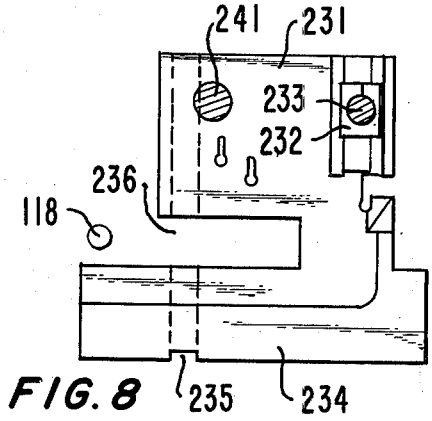
FIG. 8 is a plan view of a presser foot in the sewing machine mechanism of FIGS. 5 and 6.
Figure 9:
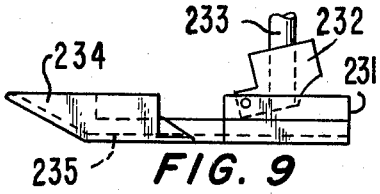
FIG. 9 is a side view taken from the right of the presser foot of FIG. 8.

As shown in FIGS. 8 and 9, a presser foot or shoe 231 is pivotally mounted on a stem 232 which is mounted on the conventional presser shaft 233 of the sewing machine. This conventional presser shaft 233 is raised and lowered by a lever (not shown) which is pivoted by the double-acting air cylinder 147 operated by the valve 144 (FIG. 23) which also operates the flypiece clamp cylinder 100 in the feeding mechanism 32 as described above. This double-acting air cylinder 147 replaces the conventional single-acting spring-return air cylinder normally employed in the sewing machine for raising and lowering the presser shaft 233. The presser shoe 231 is generally plate-like, and has a forward portion 234 which extends substantially the full width of the overlapping slide fastener chain 48 and fly piece 46. A channel 235 for receiving the top portions of the interlocking coupling elements 54 of the chain 48 extends through the bottom of the front portion 234 as well as through the remaining portion of the shoe 231 for guiding the slide fastener chain 48. A cutout 236 is formed behind the forward portion 234. The sensor 118 is positioned behind the forward portion 234 at the left edge thereof as shown in FIG. 8 to sense the presence or absence of the flypiece 46 at the sewing station.

A block 237 shown in FIG. 6 is added between the side end cover 238 of the sewing machine and the remaining body portion 239 of the sewing machine. The block 237 slidably supports a second presser shaft 241 which has a collar 242 engaged by the lower end of a compression spring 243 having its upper end retained on an adjustment screw 244. The presser shafts 233 and 241 are spaced apart so that the shaft 233 is over the right side of the flypiece 46 spaced from the slide fastener chain 48 and the shaft 241 is over the chain 48. The lower end of the presser shaft 241 abuts against the presser shoe 231 to exert a downward force thereon selected by the adjustment screw 244 to obtain even feed of the flypiece 46 and chain 48.

Other minor modifications involving simple changes in position and duplication of existing facilities are made to the mechanical parts of the sewing machine. These other modifications include the addition of thread guides and thread feeding arrangements for accommodating two additional threads as well as changes necessary to shift the looper rocker 223 to provide a larger spacing between the straight line stitching and the overedge stitching. Inasmuch as these minor modifications can be readily performed by a mechanic skilled in the art, such modifications are not described in detail.

The sewing machine motor unit 197 of FIG. 1 is connected to the three phase power lines from fuses 124 shown in FIG. 23 by a starting circuit including a starting relay 246 having normally open contacts 247, 248 and 249 connected in series with respective excess current sensors 250, 251 and 252 between the three phase power lines and the inputs of the motor unit 197. The winding of the relay 246 is connected in series with normally closed contacts 253 of the excess current sensor, with a normally closed manual push button stop switch 254, and with a parallel arrangement of normally open manual pushbutton start switch 255 and normally open latching contacts 256 of relay 250; this series circuit being connected across lines 140 and 142 from the transformer 128. Voltage serge protectors 257 are connected across the inputs to the motor unit 197. The motor unit 197 has a rotating output shaft (not shown) operated by a brake and variable speed clutch mechanism (not shown) controlled by inputs on lines 258, 259, 260 and 261 from control circuit 136. An open circuit between lines 258 and 259 results in the output shaft of the motor unit 197 being stopped while a closed circuit between lines 258 and 259 results in rotation of the output shaft at a speed proportional to the value of a resistance connected across lines 260 and 261.

In the control circuit 136 shown in FIG. 24, the output of the nand gate 169 is connected by an input resistance 263 to the base of a NPN transistor 264 which has its emitter connected to ground 162 and its collector connected to one end of a load resistance 265 which is coupled at its other end to the voltage terminal 167. The collector of the transistor 264 is also connected to the base of a NPN transistor 266 having an emitter connected to ground 162 and having a collector connected to the anode of a diode 267; the cathode of the diode 267 being connected to the line 163. A resistance 268 and zener diode 269 are connected across the emitter-collector of the transistor 266 with the anode of zener diode 269 connected to the emitter for protecting the transistor 266 from excess voltages. A series circuit including a normally closed emergency stop switch 270 and a normally closed excessive loop limit switch 271 couples the collector of the transistor 266 to an input of an electronic relay 272. This relay 272 is a conventional electronic relay including two outputs coupled to respective lines 273 and 274; the output 273 following the positive and zero condition of the input while the output 274 is inverted with respect to the output of line 273. The output line 273 is connected to both inputs of a nor gate 275, these inputs being normally biased to ground by a resistance 276. The output of the nor gate 275 is coupled by an input resistance 278 to the base of a NPN transistor 280 which has its collector and emitter connected to the respective stop-start control lines 258 and 259; the line 259 and the emitter of the transistor 280 being joined to the ground 162. The collector of the transistor 280 is connected to the cathode of a diode 282 which has its anode connected by load resistance 284 to the voltage terminal 167. The junction between the resistance 284 and diode 282 is connected by an input resistance 286 to the base of an NPN transistor 288 which has an emitter and collector connected in series with a light emitting diode 290 and a current limiting resistance 292 between the voltage terminal 167 and the ground 162. The light emitting diode 290 is a portion of a light coupled relay unit 294 which includes a light sensitive or photo transistor 296 which has a collector and emitter connected across the speed control lines 260 and 261.

The output line 274 of the electronic relay 272 is coupled to one input of a nor gate 300; this input being coupled by a bias resistance 302 to the ground 162. The output of the nor gate 300 is connected by a coupling capacitance 304 to the both inputs of a nor gate 306 which has its output coupled back to the other input of the nor gate 300. The inputs on the nor gate 306 are connected by biasing resistance 308 to the voltage terminal 172. The output of the nor gate 306 is also connected to both inputs of a nor gate 310 which has its output coupled to a negatively triggered input of a one shot or monostable multivibrator circuit indicated generally at 312. A positive going output of the one shot 312 is coupled by an input resistance 314 to the base of an NPN transistor 316 having an emitter connected to ground and a collector connected in series with a light emitting diode 318 and current limiting resistance 320 to the voltage terminal 167. The light emitting diode 318 is a portion of a light coupled relay unit 322 which includes a light sensitive transistor 324 connected in series with a potentiometer or variable resistance 326 across the speed control lines 260 and 261. Also the positive going output of the one shot circuit 312 is coupled to both inputs of a norgate 328 which has its output connected by an input resistance 329 to the base of an NPN transistor 330 having an emitter grounded and a collector connected in series with a light emitting diode 332 and a current limiting resistance 334 to the voltage terminal 167. The light emitting diode 332 is a portion of a light coupled relay unit 336 which also includes a light sensitive transistor 338 coupled in series with a potentiometer or variable resistance 340 across the speed control lines 260 and 261. The variable resistance 326 is adjusted to be smaller in value than the variable resistance 340 to produce a lower speed in the sewing machine motor.

Conveniently the nor gates 275, 300 and 306 are on one integrated circuit unit, the nor gates 310 and 328 are on another integrated circuit unit, and the one shot 312 includes an integrated circuit unit to which a resistor, two capacitators and other connections have been added in a conventional manner to produce a delay of a selected duration, for example, corresponding to 5 or 6 stitches. These integrated circuit units as well as the electronic relay 272 have power inputs connected across terminal 172 and ground 162.

In operation of the sewing machine 34 shown in FIG. 1, the sensing of the presence of a flypiece 46 at the sewing station by the sensor 118 operates the sensing and relay circuit 149 in FIG. 24 to close contacts 158 and produce a zero output on nandgate 169. The zero output of nandgate 169 renders transistor 264 non-conductive which in turn renders transistor 266 conductive to apply a logic zero through switches 270 and 271 to the input of the electronic relay 272. Output line 273 is rendered to zero by the zero input on electronic relay 272 to produce a positive output on nor gate 275 which in turn renders transistor 280 conductive completing a circuit between lines 258 and 259 which operates sewing machine motor unit 197 in FIG. 23 to drive the sewing machine.

The output line 274 of the electronic relay 268 becomes positive with the zero input thereof and causes the output of nor gate 300 to produce a zero. The negative going output on the nor gate 300 is passed by the capacitance 304 to the inputs of the nor gate 306 causing the nor gate 306 to produce a positive output pulse which is inverted by the nor gate 310 and applied to the negatively triggered input of the one shot circuit 312. The one shot 312 produces an output pulse of a selected duration to render transistor 316 conductive during this duration causing the light emitting diode 318 to render the light sensitive transistor 324 conductive and connect the resistance 326 across the speed control lines 260 and 261. Since the value of resistance 326 is relatively low, the sewing machine operates at a first low rate of speed, for example 200 revolutions per minute, for the duration of the one shot output or for about 5 or 6 stitches. When the output of the one shot circuit 312 reverts to zero, the output of nor gate 328 becomes positive to render the transistor 330 conductive which activates the light emitting diode 332 to render the light sensitive transistor 338 conductive and thus connect the resistance 340 across the speed control lines 260 and 261; the resistance 326 being disconnected by transistors 316 and 324 becoming non-conductive. The resistance 340 causes the sewing machine motor to run at a high speed, for example 1700 or 1800 revolutions per minute.

When the sewing of the flypiece 46 has advanced the trailing edge of the flypiece past the sensor 118, the contacts 158 open and the output of nand gate 178 goes positive which renders transistor 264 conductive causing transistor 266 to become non-conductive and apply a positive to the input of electronic relay 272. Output line 273 also goes positive to render the output of nor gate 275 zero causing the transistor 280 to become non-conductive producing a stop signal on lines 258 and 259 which subsequently results in stopping of the sewing machine; the unit 197 in FIG. 23 including the zero sensor 206 in FIG. 2 causing the sewing machine 34 to stop with the needles in the exact up condition, or if the zero sensor 206, is reversed, causes the sewing machine to stop with the needles in the exact down position. Also the rendering of the transistor 280 non-conductive applies a positive voltage to the base of transistor 288 rendering this transistor conductive to activate light emitting diode 290 which renders light sensitive transistor 296 conductive producing a very low resistance across the speed control lines 260 and 261; this further aids in bringing the sewing machine to a rapid stop; for example in about three stitches.

During the feeding of the next flypiece as described above, the four-way valve 144, FIGS. 23 and 24, operates the air cylinder 147 to raise the presser foot shaft 233 of FIG. 6 and the presser shoe 231; the second presser shaft 241 is also lifted by the presser shoe 231. This lifting occurs simultaneously with the clamping of the flypiece by the clamp member 90, FIG. 4, and throughout the period that the flypiece is advanced by the forward movement of the carriage 88 to allow the leading end of the flypiece being fed to be inserted between the shoe 231 and the feeder 226 under the slide fastener chain. When the clamp is released the air cylinder 147 lowers the presser shoe raising mechanism of the sewing machine and thus the leading end of the flypiece is gripped between the shoe 231 and the feeder 226 by the spring bias on shafts 233 and 244 during retraction of the carriage 88.

The provision of a separate shaft 241 engaging the presser shoe 231 results in even feeding of the fastener chain 48 and flypieces 46 through the sewing station of the sewing machine 34. Attempts to provide conventional bias on the pressure shoe 231 by the single shaft 233 resulted in distorted movement of the flypieces 46 and chain 48 through the sewing station producing curvature in the product. This curvature is eliminated by the separate shaft 241 engaging the presser shoe 231 and being adjusted by the screw adjustment 244 to apply a set amount of gripping force between the shoe 231 and the feeder 226. Further the adjustment of the screw 244 may be changed for different flypiece and fastener chain materials to obtain even feeding of these materials.

The advancement of the next flypiece 46 under the presser shoe 231 in the sewing station is sensed by the sensor 118 and circuit 149, FIG. 24, to close contacts 158 and begin another sewing cycle.

Operation of the emergency stop switch 270 or the excess loop limit switch 271 operates the electronic relay 272 to stop the sewing machine in the same manner as the sensing of the trailing end of a flypiece by the sensor 118 stops the sewing machine.

Loop Control

The loop control mechanism 36, as shown in FIG. 1, includes a wheel 350 mounted by a bracket 352 on the table 30 behind the sewing machine 34 for directing the continuous slide fastener chain with attached flypieces downward through an opening 354 in the table 30 underneath which the loop 62 in the chain with attached flypieces is formed. A vertical rail or post 356 is mounted underneath the table 30 and slidingly guides a block 358 which has a roller or pin 360 under which the bottom of the loop 62 of the continuous slide fastener chain with attached flypieces passes to support the block 358 against the force of gravity. The weight of the block 358 is selected to maintain tension in the loop 62. A wheel 362 similar to wheel 350 is mounted by a bracket 364 on the table 30 in front of the folder mechanism 38 for directing the continuous slide fastener chain with attached flypieces from the opening 354 toward the folder mechanism. The loop mechanism 36 includes an upper limit switch 366, an intermediate or lower limit switch 368 and the lowest limit switch 271. The lowest limit switch 271 is connected in the control circuitry for energizing the motor unit 197 of the sewing machine 34 as shown in FIG. 24 and described above for stopping the sewing machine 34 in the event that the loop 62 reaches its lowest limit.

Figure 25:
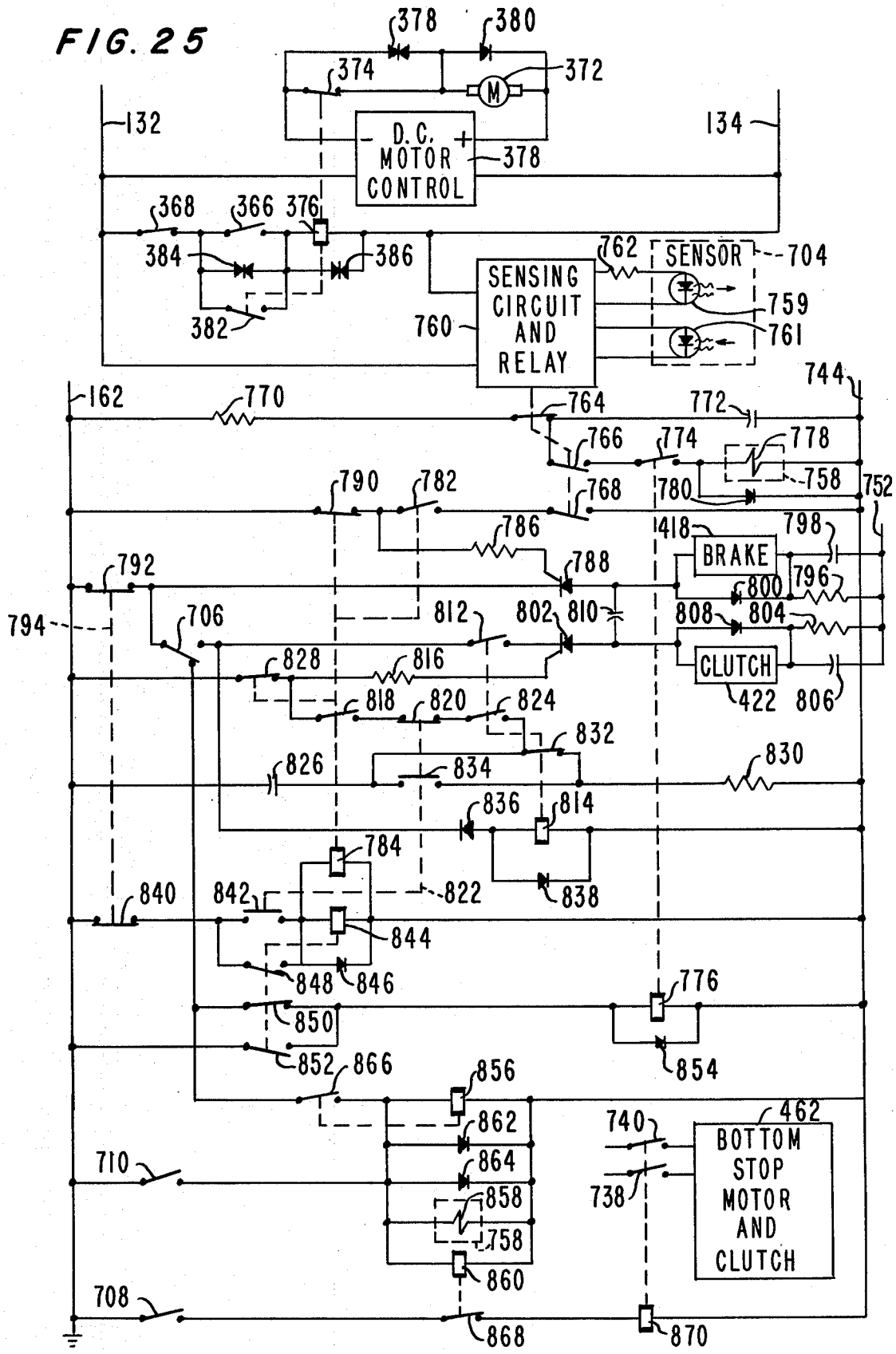
FIG. 25 is a detailed diagram of another control circuit portion of the circuitry of FIG. 23.

As illustrated in FIG. 23, the upper limit switch 366 and the lower limit switch 368 are connected to a control circuit 370 for the bottom stop gapping and cutting mechanism along with the power lines 132 and 134. Referring to FIG. 25, this control circuit 370 includes a direct current motor 372 having its inputs connected in series with normally closed contacts 374 of a relay 376 to the outputs of a conventional DC motor control circuit 378 connected across the power lines 132 and 134. The motor 372 drives the feeding mechanism for the folder 38, FIG. 1, as well as the bottom stop applying, gapping and cutting mechanism 40 as is described hereafter. A serge protector 378 is coupled across the contacts 374 and a diode 380 is coupled across the inputs of the motor 372 to bypass inductive currents during shut down of the motor. The upper limit switch 366, which is normally open is connected in series with the winding of the relay 376 and the lower limit switch 368, which is normally closed, across the power lines 132 and 134. The relay 376 has normally open latching contacts 382 which are connected in parallel with the upper limit switch 366. Voltage serge protectors 384 and 386 are connected across the switch 366 and the winding of the relay 376 respectively.

In operation of the loop control mechanism if the loop 62 becomes excessively long, the block 358 slides down the rail 356 operating the switch 271 which as shown in FIG. 24 opens the circuit to the input of the electronic relay 272 stopping the sewing machine 34 as described above. The sewing machine 34 is permitted to restart after the block 358 is lifted to disengage the switch 271. If the loop 62 of the slide fastener chain with attached flypieces becomes too short and operates the upper limit switch 366, the circuit to the relay 376 as shown in FIG. 25 is completed to energize the relay 376 and open contacts 374 to deenergize the motor 372. This prevents feeding further feeding of the slide fastener chain with attached flypiece in the folder 38 as well as the bottom stop applying, gapping and cutting mechanism 40. The relay 376 remains actuated through latching contacts 382 to maintain the motor 372 unoperated until the loop 62 increases sufficiently to move the slide block 358 downward to engage the lower limit switch 368. This opens the circuit to the relay 376 resulting in the contacts 374 closing to energize the motor 372 and permit operation of the feeding mechanism for the folder 38 and the bottom stop applying, gapping and cutting mechanism 40.

Normally the bottom stop applying, gapping and cutting mechanism 40 operates at a faster rate than the sewing machine 34. Thus the loop control 36 normally stops the mechanism 40 when the loop 62 reaches the upper limit 366 and then restarts the mechanism 40 when the loop 62 reaches the lower limit 368. The use of the relay 376 with latching contacts 382 reset by the lower limit switch 368 provides relatively long periods when the bottom stop applying, gapping and cutting mechanism 40 is permitted to operate. This avoids oscillation of the feeding of the product to the mechanism 40.

Folding and Feeding Mechanism

Figure 14:
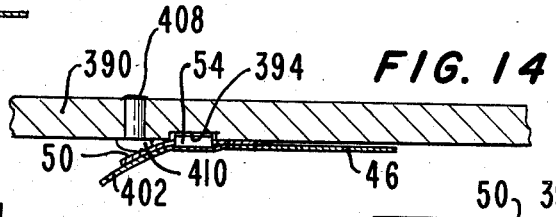
FIG 14 is a cross section view taken at line 14—14 in FIG. 12.
Figure 15:
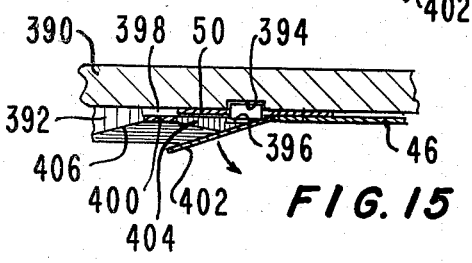
FIG. 15 is a cross section view taken at line 15—15 in FIG. 12.

The folding and feeding mechanism 38 as shown in FIGS. 11, 12, 13, 14, 15 and 16, includes an upper plate-like member 390 and a lower plate like member 392 which are secured together and fastened on a base 393 supporting the slide fastener bottom stop machine on the table 30 (FIG. 1). An arm 395 also secured on the base 393 extends toward the front and has a guide 397 thereon in front of the folder members 390 and 392 for guiding the slide fastener chain with attached flypieces from the pulley 362. The upper and lower plate members 390 and 392 have respective channels 394 and 396 formed therein and extending longitudinally thereof for receiving the upper and lower portions of the interlocking coupling elements 54 of the slide fastener chain 48 while a wider but shallower channel 398 is formed in the bottom plate member 392 for receiving the tapes 50 and 52 of the slide fastener chain. The bottom plate like member 392 has a forward end tapered to terminate in a tip 400 which is offset to the left side of the grooves 394 and 396 but in line with the left portion 402 of the flypiece 46 as shown in FIG. 15. A sloping surface 404 extends backward on the front of the member 392 from the tip 400 across the channels 394 and 396 so as to fold the portion 402 underneath the remaining portion of the flypiece 46. A sloping surface 406 is formed on the underside of the member 392 and extends from the tip 400 downward to form a relatively sharp or narrow tip 400. A member such as a screw 408 having a round head 410 is mounted on the underside of the upper member 390 in the path of the tape 50 and the left portion 402 of the flypiece 46. A deeper channel 412 is formed on the member 392 parallel the channels 396 and 398 for receiving the flypiece 46 including the folded portion 402.

The motor 372 (described above in connection with the loop control 36 and FIG. 25) is mounted on the table 30 as shown in FIG. 2 and is drivingly connected to a shaft 414 by means of a belt and pulley arrangement 416. The shaft 414 has one end coupled to an electro-magnetic brake 418 mounted by a bracket 420 on the table 30 and has the other end coupled to an electro-magnetic clutch 422 which is also coupled to one end of a shaft 424. The operating circuitry for the brake 418 and clutch 422 are described hereafter under bottom stop applying, gapping and cutting mechanism. A chain and gear arrangement 426 couples the shaft 425 to a shaft 428 which is coupled to a one way clutch 430. This one way clutch 430 is suitably coupled to a shaft 431, FIGS. 11 and 12 supporting a drive wheel 432 for the slide fastener chain and attached flypieces and is of the type permitting free counterclockwise rotation of the shaft 431 and drive wheel 432 as shown in FIG. 12 but upon counterclockwise rotation of the shaft 428 drivingly connects the shaft 428 to the shaft 431 and wheel 432. The wheel 432 is supported by a suitable bracket 434 at the rear end of the folder plates 390 and 392. A carriage 436 is mounted at its rear end on a bracket 438 on the table 30 and extends toward the front over the wheel 432 to a forward end which is biased downward by a compression spring 440 between the carriage 436 and the bottom of the bottom stop machine. A roller 442 mounted in an intermediate portion of the carriage 436 engages the top of the wheel 432 so as to grip the continuous slide fastener chain and attached flypieces therebetween.

Figure 16:
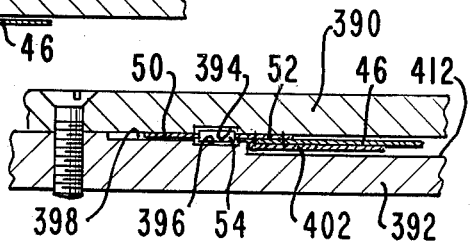
FIG. 16 is a cross section view taken at line 16—16 in FIG. 12.

In operation of the folder 38, counterclockwise rotation of the drive wheel 432, FIG. 12, by means of the motor 372 (FIG. 2), belt 416, shaft 414, clutch 442, chain 426, shaft 428, one-way clutch 430 and shaft 431 (FIGS. 11 and 12) pulls the continuous slide fastener chain 48 with attached flypieces 46 through the opening formed by the channels 398 and 412 and grooves 394 and 396 in the respective plates 390 and 392. The tape 40 and the portion 402 in the flypiece 46 are bent downward as shown in FIG. 14 as they pass over the round head 410. The tape 50 is immediately pulled back up into the channel 398 as shown in FIG. 15, but the portion 402 is engaged on top by the surfaces 404 and 406 at the tip 400. Continued advancement of the flypiece 46 causes the flypiece portion 402 to be folded under the remaining portion of the flypiece 46 away from the elements 54 by the edge 404 on the bottom member 392. The folded flypiece is received and retained within the channel 412 as shown in FIG. 16 to the right side of the fastening elements 54.

Figure 11:
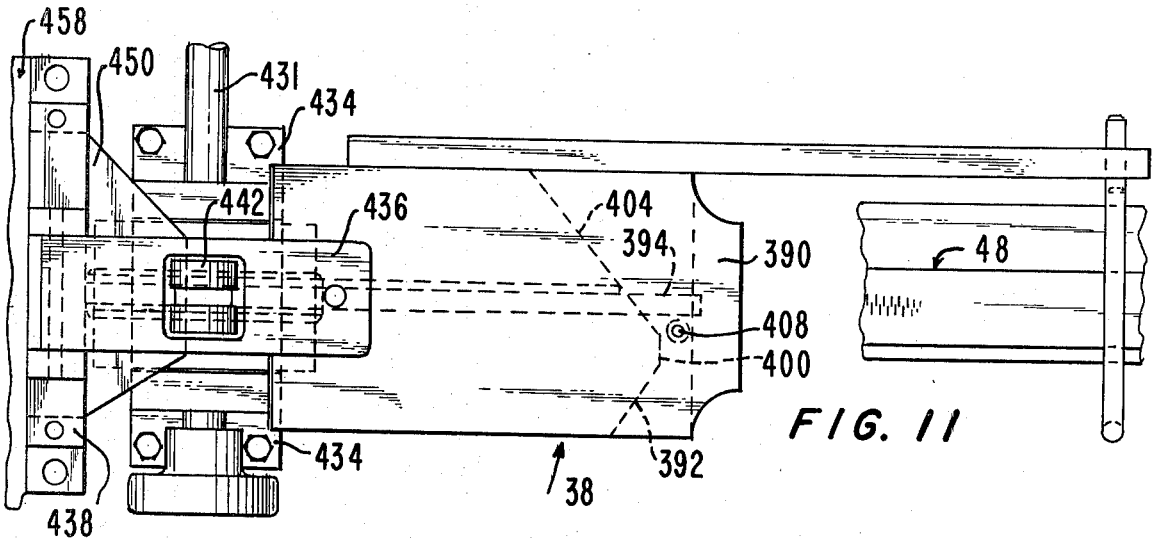
FIG. 11 is a plan view of a folder and feeding mechanism for the slide fastener with attached flypieces in the apparatus of FIGS. 1 and 2.
Figure 12:
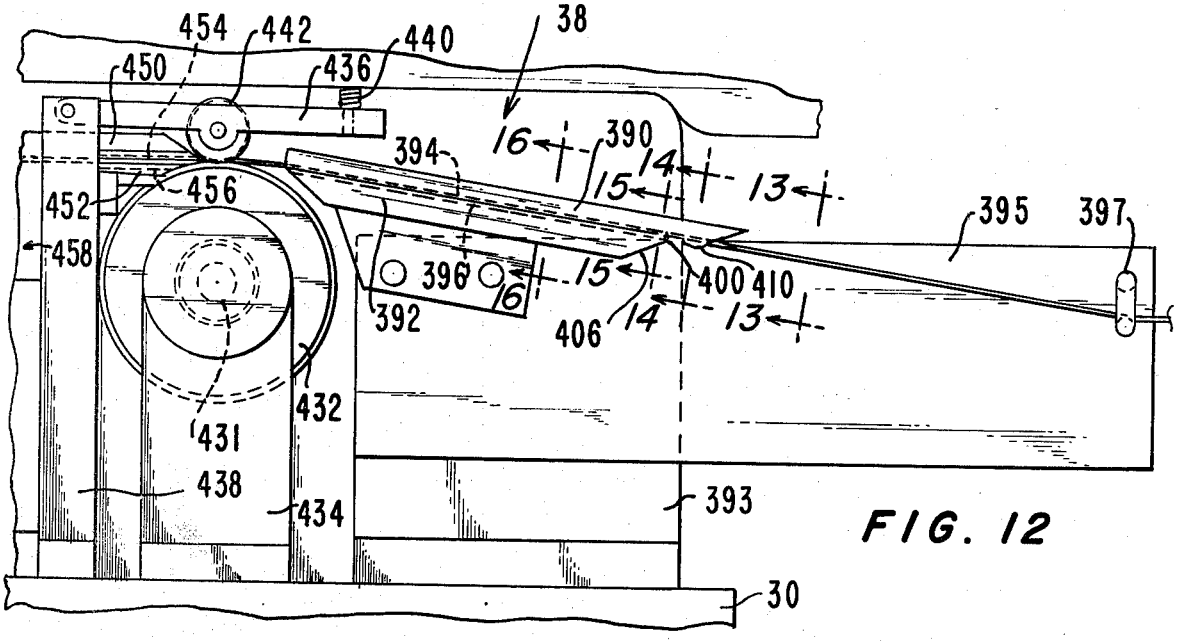
FIG. 12 is a side view taken from the left of the folder and feeding mechanism of FIG. 11.
Figure 13:
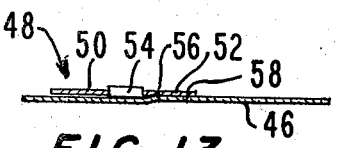
FIG. 13 is a cross section view taken at line 13—13 of FIG. 12.

As shown in FIGS. 11 and 12 an upper guide member 450 and a lower guide member 452 are mounted on the bracket 438 and extend to the exit for the slide fastener chain and attached flypiece between the roller 442 and drive wheel 432. The guide members 450 and 452 have respective grooves 454 and 456 for constraining the fastening elements 54 of the slide fastener chain 48. These coupling elements 54 are relatively incompressible in the longitudinal direction of the chain 48 and are sufficiently constrained within the channels or grooves 454 and 456 of the guide members 450 and 452 so as to permit the slide fastener chain to be fed by pushing from the drive wheel 432 between the members 450 and 452 into a base unit generally indicated at 458 of the bottom stop applying, gapping and cutting mechanism 40 shown in FIG. 1.

Bottom Stop Applying, Gapping and Cutting Mechanism

The gapping, cutting and bottom stop applying mechanism in FIG. 1 includes the base unit 458 mounted by a support 460 on the table 30, a conventional bottom stop forming machine generally indicated at 462 and which is mounted by means of the support 393 on the table 30, and a punch assembly generally indicated at 464.

The bottom stop machine 462 is a conventional machine which is electrically operated and which forms staple-like bottom stops from a ribbon-like wire. This machine includes ram means at the rear end thereof positioned over the front portion of the base unit 458 for driving a staple-like bottom stop downward into the base unit 458.

The punch assembly 464 is mounted over a rear portion of the base unit 458 and on a pair of vertically slidable rods 466 and 467 (FIG. 17) which extend through the base unit 458 and underneath the table 30. A member 468 attached to the bottom ends of the rods 466 and 467 is pivotally connected to one end of a link 470 which has its other end pivotally connected to one end of a piston rod 472 on an air cylinder 474 mounted on a bracket 476 underneath the table 30. A link 478 is also pivotally connected to the piston rod 472 at one end thereof and has its other end pivotally connected to the table 30. The links 470 and 478 are arranged in a toggle joint with the knee thereof connected to the piston rod 472 for raising and lowering the rods 466 and 467 and the punch assembly 464.

Figure 17:
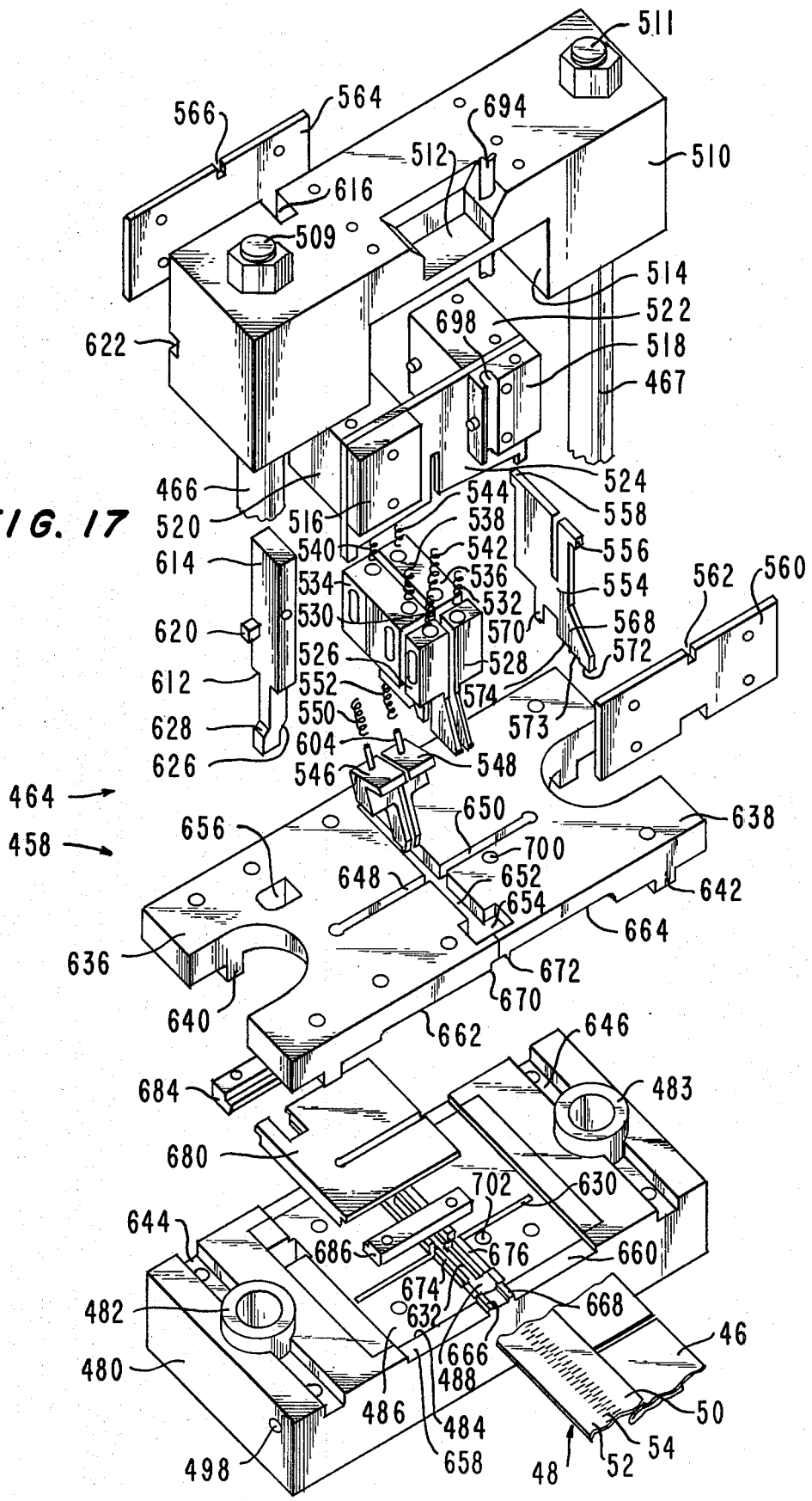
FIG. 17 is an exploded perspective view of a gapping and cutting mechanism together with a common base for both the gapping and cutting mechanism and a bottom stop mechanism of the apparatus of FIGS. 1 and 2.

The base unit 458, as shown in FIGS. 17, 18, and 19 includes a housing 480 having sleeves 482 and 483 for slidably guiding the rods 466 and 467 and having a central rectangular recess 484 in which is mounted a die member 486. An anvil 488 is supported in a recess 490 in the die member 486 centrally between the sides of the member 486 at the front edge of the member 486; the position of the anvil 488 is directly underneath the ram of the bottom stop machine 462, FIG. 1. Shims 492 in the bottom of the recess 490 support the anvil 488 in a selected raised position. Adjustment screws 494 and 496, FIG. 18, extending horizontally into opposite sides of the recess 490 from openings 498 and 500 in opposite sides of the housing 480 and die members 486, engage opposite downwardly diverging sides 502 and 504 of the anvil 488 to adjustably hold the anvil 488 in the die member 486. The sloping and diverging sides 502 and 504 form a dovetail arrangement with screws 494 and 496 to insure that the anvil is held securely in the die member 486. The anvil 488 has a top surface 506 formed in a conventional manner so as to clinch the prongs of the staple-like bottom stops formed by the bottom stop machine 462 of FIG. 1.

The punch assembly 464, as illustrated in FIGS. 17 and 19, has a housing 510 mounted on reduced ends 509 and 511 of the rods 466 and 467. The housing 510 has a recess 512 formed in the upper front surface thereof to avoid interfering with a portion of the bottom stop machine 462, FIG. 1. A central channel or recess 514 is formed from the front to the back on the underside of the housing 510. Front support blocks 516 and 518 and rear support blocks 520 and 522 are secured to the housing 510 within the recess 514. A slide fastener chain cutting blade 524 extends transversely across the recess 514 and is fastened at the left between front block 516 and rear block 520 and at the right between front block 518 and rear block 522. Front pressers 526 and 528 have upper block-like portions which are slidably mounted between the respective front support blocks 516 and 518 and the gapping punch 554. Compression springs 530 and 532 between the housing 510 and the top surface of the pressers 526 and 528 bias the pressers 526 and 528 downward. Rear pressers 534 and 536 have upper block-like portions which are slidably mounted between the respective rear support blocks 520 and 522 and the punch 554. Compression springs 538, 540, 542 and 544 between the housing 510 and the top of the pressers 534 and 536 bias the pressers 534 and 536 downward. All the pressers 526, 528, 530 and 532 have lower-blade-like portions with flat bottom edges for engaging the upper outer portions of pluralities of the fastening elements 54. Fastener element locating members 546 and 548 are slidably mounted within the respective rear pressers 534 and 536 for sliding relative thereto at an angle extending upward and toward the rear. Compression springs 550 and 552 between the upper surface of the fastener element locating members 546 and 548 and the respective pressers 534 and 536 bias the locating members 546 and 548 downward. The springs 550 and 552 have substantially less compressive strength than the springs 538, 540, 542 and 544.

The gapping punch 554 extends at the front between front pressers 526 and 528 and at the rear between the rear pressers 534 and 536, and includes upper front tab 556 and an upper rear tab 558. A front punch retaining plate 560 is mounted on the front surfaces of the support blocks 516 and 518 and has a notch 562 in its upper edge for receiving the tab 556 while a rear punch retaining plate 564 is mounted on the rear surfaces of the rear support blocks 520 and 522 and has a notch 566 in its upper surface for receiving the tab 558 of the punch 554 to retain the punch 554 in the assembly.

The punch 554 has a front portion 568 for forming the gap 68 in the coupling elements 54 (FIG. 3) and has a rear punch portion 570 for forming the gap 66 in the coupling elements. The front portion 568 extends forward from the punch assembly 464 to bring its forward edge closely positioned to vertical alignment with the rear side of the anvil 488. Additionally the front portion 568 has a plurality of steps 572, 573 and 574 so that only a few of the elements 54 are cut by each step at successive intervals as the punch 554 is lowered.

As shown in FIGS. 19 and 20 the right front presser 528 has the upper block portion 576 with a vertically elongated opening 578 formed therein into which extends a pin 580 mounted in the front right support block 518 for guiding and retaining the presser 528. The ends of the spring 532 are retained in respective recesses within the top of the block portion 576 and the top wall of the recess 514 in the housing 510. The member 528 also includes a lower blade-like portion 582 with a flat bottom surface for engaging the tops of a plurality of the elements 54. This lower portion 582 extends downward alongside the gapping punch 554 and has a front extending portion matching the front extending portion 572 of the punch 554.

The right rear presser 536 includes the block portion 584 which has a pair of elongated openings 586 and 588 receiving respective pins 590 and 592 mounted in the right rear support block 522 for guiding and retaining the presser 536. Also the presser 536 has a lower blade-like portion 594 extending downward contiguous with its left-most side against the punch 554 and in alignment with the blade-like portion 582 of the pressure pad 528. The springs 542 and 544 are retained at their opposite ends in respective recesses in the top surface of the block portion 584 of the presser 536 and in the top surface of the recess 514 in the housing 510.

The element locating member 548 as shown in FIG. 20 has an upper portion 596 which is slidably retained within a cavity 598 within the left face of the block portion 584 of the presser 536 by a ledge 600 on the member 548 abuting a shoulder 602 of the presser 536 bordering the cavity 598. The spring 552 as shown in FIG. 17 is retained by a suitable pin 604 extending from the upper surface of the member 548. The upper portion 596 of the member 548 has a width substantially greater than that of the lower portion 606 thereof which corresponds to the thickness of the blade like portion 594 of the pressure pad 536 but is substantially less in width than the width of the presser pad 536. The lower portion 606 extends within a slot 608 formed through the lower plate like portion 594 towards the forward bottom end thereof at an acute angle. The portion 606 terminates in a tip 610 designed to fit into interstices between elements 54 which are mounted on the tape 50 of the slide fastener chain 48.

The left front presser 526, the left rear presser 534 and the left element positioning member 546 are mirror images of the right front presser 528, the right rear presser 536 and the right element positioning member 548 except that the tip on the lower extending portion of the left positioning member 546 corresponding to the tip 610 shown in FIGS. 20 and 21 is offset relative to the tip 610 along the longitudinal direction of the slide fastener chain 48 so that such tip will engage in an interstice between the fastening elements on the tape 52; the elements 54 mounted on the tape 50 are interlocked between the elements 54 mounted on the tape 52 and thus the tips on the respective members 546 and 548 are accordingly offset. The pressers 526 and 534 are slidingly retained by pins extending from the support blocks 516 and 520 in a manner similar to the pressers 528 and 536.

A camming member 612, FIGS. 17 and 19, has an upper portion 614 with a rectangular cross section mounted within a vertical slot 616 in the rear of the housing 510 and is secured therein by means of a bolt or screw 618. A locking projection 620 extends from the left side of the member 614 and is engaged in a horizontal slot 622 in the rear of the housing 510. The lower portion of the cam member 612 extends downward from the housing 510 and has leftward and downward extending camming surfaces 626 and 628 on the right and left sides respectively.

Referring back to the base unit 458, the die member 486 has a slot 630 aligned with the chain cutting blade 524 with sharp edges for cooperating with the blade 524 to sever the tapes of the slide fastener chain 48. A slot 632 extends from the anvil 488 back toward the rear of the die member 486 in alignment with the gapping punch 554 for cooperating with the rear portion 570 and the forward portion 568 of the gapping punch to sever elements 58 to form the gaps 66 and 68 (FIG. 3). The slots 630 and 632 extend vertically through the die member 486 to an opening 534 in the bottom of the base housing 480 for directing the severed material into a suitable disposal receptacle (not shown).

The blade 524, FIGS. 17 and 19, has downward extending guide portions at the right and left bottom corners thereof for cooperating with the respective right and left ends of the slot 630 to guide the blade 524, and has bottom shearing edges which extend at an upward sloping angle from these bottom corners to the center of the blade 524 for producing cutting beginning at the outer edges of the tapes 50 and 52 and progressing to the inner edges of the tapes.

In a modification of the chain cutting blade 524 and die 486 shown in FIG. 22, the slot 630 (FIG. 19) in the die 486 is eliminated and the bottom of the blade 524 is formed with a horizontal sharp edge 635 which cooperates with the upper surface of the die 486 to cut the tapes 50 and 52 of the slide fastener chain 48.

The base unit 458 also includes a left cover member 636 and a right cover member 638 with respective ridges 640 and 642 mating with grooves 644 and 646 in the housing 480. Suitable means such as screws fasten the cover member 636 and 638 to the housing 480. The covers 636 and 638 have respective slot halves 648 and 650 extending from the inner edges thereof to the left and right respectively in alignment with the tape cutting blade 524 for preventing free movement of the blade 524 therethrough. Similarly an opening or slot 652 is formed between the inner edges of the members 636 and 638 for permitting free passage of the lower blade-like portions of the pressers 526, 528, 534 and 536 as well as the gapping punch 554. An enlarged opening 654 is formed in the covers 636 and 638 over the anvil 488 for permitting passage of the ram of the bottom stop machine 462, FIG. 1. A vertical opening 656 is formed through the cover member 636 in alignment with the lower portion of the cam member 612 for permitting free movement of the lower portion of the cam 612 therethrough.

Channels 658 and 660 are formed from front to back in the housing member 480 and die member 486, and channels 662 and 664 are formed from front to back in the respective left and right cover members 636 and 638 for forming a passage for the tapes 52 and 50 as well as the folded flypieces 46 through the base unit 458. A pair of ridges 666 and 668 are formed on the top of the front portion of the housing 480, and a shoulder 470 and a ridge 472 are formed on the bottom surfaces of the front portions of the respective cover members 636 and 638 to define a restricted guide passage for the fastening elements 54 to accurately direct the slide fastener chain 48 over the anvil 488 from the guide members 450 and 452 in FIG. 12. Ridges 674 and 676 protrude upward on the die member 486 from the anvil 488 to the rear of the member 486 and are spaced apart to form a channel for receiving and accurately positioning the lower portions of the fastening elements 54 over the die cutting slot 632. A ridge 678 on the right cover member 638 extends over the ridge 676 and cooperates therewith to retain the right edge of the coupling elements 54. A movable guide or plate member 680 is slidably mounted within a recess 682 in the underside of the cover member 636 by means of a pair of gibs 864 and 686 (FIG. 17) mounted on the underside of the cover member 636 and has an opening 688 aligned with the lower portion of the cam member 612. A cam surface 690, is formed on the movable guide 680 at the right edge of the opening 688 for cooperating with the camming surface 626 on the cam 612 to move the movable plate 680 to the right so that the right edge thereof forms a shoulder aligned with the ridge 674 to position and hold the fastening elements 54 over the cutting slot 632 in the die member 486. At the left edge of the opening 688, camming surface 692 on the movable plate 680 is engageable by the camming surface 628 on the cam member 612 to move the guide 680 to the left as shown in FIG. 19. The horizontal component of the camming surface 628 is selected to move the plate 680 sufficiently to permit the staple or bottom stop 70 (FIG. 1) to pass freely over the ridge 674 on die member 486 and out of the rear of the base unit 458.

A fiber optic tube or light conductor 694 mounted on a stationary bracket 695 (FIG. 1) extends downward through an opening 696 in the housing 510, an opening 698 in the front right support block 518, and an opening 700 in the right cover member 638 in alignment with an opening 702 through the die member 486 which is just in front of the slot 630. This fiber optic tube is a conventional fiber optic tube such as model number B824 from Dolan Jenner Industries, Melrose, Mass. The fiber tube 694 is coupled to the sensor 704 (FIG. 25) which is substantially identical to sensors 116 and 118 (FIG. 24) which have been described above.

As illustrated in FIG. 1, there are three switches 706, 708, 710 suitably mounted on the support 476 for being operated by the member 468 or other means movable with the rods 466 and 467. The switch 706 is operated when the punch assembly 464 is in the fully raised position; the switch 710 is positioned to be operated when the punch assembly 464 is in the lowest position; and the switch 708 is positioned to be operated when the punch 464 is in an intermediate position.

As shown in FIG. 23, the bottom stop motor and clutch mechanism of the bottom stop machine 462 in FIG. 1 is coupled to the three-phase AC input through normally open contacts 712, 714, 716, of relay 718 and excessive current sensors 720, 722, and 724. The winding or the relay 718 is connected in series with normally closed contacts 726 of the excess current sensing unit, a normally closed manual push-button stop switch 728 and a normally open manual push button start switch 730 across the lines 140 and 142. Normally open latching contacts 732 of the relay 718 are connected across the start switch 730. Voltage surge protectors 734 are connected across the three phase inputs of the bottom stop machine 462. The bottom stop machine 462 includes a solenoid 736 having its opposite ends connected by respective normally open contacts 738 and 740 to two of the three power input lines. These contacts 738 and 740 are relay contacts operated by the control circuit 370.

A full wave rectifier circuit 742 has inputs coupled to the lines 140 and 142 and has a positive voltage output connected to line 744 with the other or negative output connected to the ground line 162. A filter capacitance is coupled across the lines 162 and 744. Similarly a full wave rectifier 750 has inputs connected across the lines 132 and 134 and has a positive output connected to line 752; the negative output of rectifier circuit 750 being connected to ground 162. A filter capacitor 756 is coupled between the line 752 and ground 162. The lines 744 and 752 as well as ground 162 are connected to the control circuit 370. The control circuit 370 operates the tape feed brake 418 (FIG. 2), the tape feed clutch 422, and a four-way valve 758 which controls the air cylinder 474 (FIG. 1).

In the control circuit 370 as shown in FIG. 25, the light emitting diode 759 and the light sensitive or photo diode 761 in the sensor 704 are coupled to a sensing circuit and relay unit 760 which is coupled to the power lines 132 and 134. A protective resistor 762 is connected in series with the light emitting diode 759. The sensing circuit and relay circuit 760, for example, may be formed by an assembly of parts PAN-2, PAN-102, and PAN-208 from Fork Standard Incorporated 211 Main St. West, Chicago, Ill. The sensing circuit 760 pulses the light emitting diode 759 in the sensor 704 at a selected frequency and detects signals of the selected frequency from the light sensing diode 761. The ciccuit 760 is set to operate when a gap 194 (FIG. 3) between flypieces 46 is sensed. The relay in the unit 760 includes normally closed contacts 764, normally open contacts 766, and normally open contacts 768. The normally closed contacts 764 are connected between a resistor 770 and a capacitor 772; the capacitor 772 is connected at its other side at the voltage line 744 while the resistor 770 is connected at its opposite end to the ground line 162. The normally open contacts 766 are connected on one side between the junction of contacts 764 and capacitor 772 and on the other side in series with normally open contacts 774 of a relay 776 and the advance solenoid 778 of the valve 758 (FIG. 23). A diode 780 is connected across the solenoid 778 with its cathode connected to line 744. The capacitance 772 is selected to provide a discharge current sufficient to operate the solenoid of valve 758 while the resistance 770 is selected to provide a suitable charging current to the capacitance 772. The contacts 768 are connected between line 744 and normally open contacts 782 of a relay 784, the other side of contacts 782 joined by a protective resistor 786 to the gate electrode of a silicon controlled rectifier (SCR) 788. The junction of the contacts 782 and the resistor 786 is connected to the ground line 162 by normally closed contacts 790 of the relay 784. The cathode of the SCR 788 is connected to the ground line 162 by normally closed contacts 792 of a manual push bottom stop switch 794, while the cathode of the SCR 788 is connected in series with the magnetic brake 418 and a resistance 796 to the voltage line 752. A capacitance 798 is coupled across the resistance 796 while a diode 800 is connected across the magnetic brake 418; the cathode of the diode 800 being connected to the junction between the resistance 796 and the brake 418. A SCR 802 has an anode connected in series with the magnetic clutch 422 and a resistor 804 to the line 752 with a capacitor 806 being coupled across the resistance 804 and a diode 808 being coupled across the clutch 422. The capacitances 798 and 806 are selected to provide predetermined current discharges through the respective brake 418 and clutch 422 to obtain fast operation thereof. The resistors 796 and 804 are selected to limit the current through the brake 418 and clutch 422 and maintain their operated condition. A capacitance 810 is coupled between the anodes of the SCR's 788 and 802; this capacitance 810 is selected to receive a charge sufficient to drive the anode of either SCR 788 or 802 negative when the other SCR 788 or 802 becomes conductive. Normally open contacts 812 of a time delay relay 814 are connected between the cathode of SCR 802 and a normally open contact of the upper limit switch 706 (see also FIG. 1) which is a double-throw switch and has a contact arm to the junction between the contacts 792 and the cathode of the SCR 788. The gate electrode of the SCR 802 is connected to a series circuit including a resistance 816, normally open contacts 818 of the relay 784, normally closed contacts 820 of a manual push button start switch 822, and normally open contacts 824 of the time delay 814, to one side of a capacitance 826 which has its opposite side connected to the ground line 162. The junction between the resistance 816 and the normally open contacts 818 is connected by normally closed contacts 828 of the relay 784 to the ground line 162. A charging resistance 830 for the capacitance 826 is connected in series with the parallel arrangement of normally closed contacts 832 of the time relay 814 and normally open contacts 834 of the start switch 822 between the voltage line 744 and the side of the capacitance 826 connected to the switch 824. The time delay relay 814 is connected on one side to the voltage line 744 and on its opposite side to the anode of a diode 836 which has its cathode connected to the normally open contact of the switch 706. A protective diode 838 is connected across the time delay relay 814 with its cathode being connected to the line 744. Normally closed contacts 840 of the stop switch 794 and normally open contacts 842 of the push bottom start switch 822 are connected in series with each other and a parallel arrangement of the winding of the relay 784 and a winding of a relay 844; this series circuit is connected between the voltage 744 and ground line 162. A protective diode 846 is connected across the parallel relay windings 784 and 844, the cathode of the diode 846 being directed toward the voltage line 744. The relay 844 includes normally open contacts 848 connected in a latching circuit across the normally open contacts 842 of the start switch 822, normally closed contact 850 connected between a normally closed contact of the double-throw limit switch 706 and the winding of the relay 776 which is joined at its opposite side to the line 744, and normally open contacts 852 connected between the ground line 162 and the junction between the contacts 850 and the winding of relay 776. A protective diode 854 is connected across the winding of the relay 776. The limit switch 710 is a normally open switch and is connected between the ground line 162 and one side of a parallel arrangement of a winding of a relay 856, a return solenoid 858 of the valve 758 (FIG. 23), and a winding of a relay 860; the other side of this parallel arrangement connected to voltage line 744. A pair of protective diodes 862 and 864 are coupled across the parallel arrangement of the windings of relays 856 and 860 and the solenoid 858. The relay 856 includes normally open contacts 866 connected between the normally closed contact of the double-throw limit switch 706 and the junction between the switch 710, the winding of relay 856, the solenoid 858 and the winding of relay 860. The relay 860 includes normally closed contacts 868 connected in series with the limit switch 708, which is normally open, and the winding of a relay 870 which includes the contacts 738 and 740 for operating the solenoid 746 (FIG. 23) in the bottom stop machine 462.

A cooling fan 873, FIG. 23, is provided for cooling electrical components of the apparatus.

In FIGS. 1 and 2, a pull off wheel 874 is mounted on the shaft 424 directly behind the base unit 458. A roller 876 is mounted over the wheel 874 on a manually operated eccentric 878 for cooperating with the wheel 874 to pull slide fastener units with attached flypieces from the base unit 458. The pull-off wheel 874 is selected so as to advance the slide fastener units at a slightly faster speed than the pushing wheel 432 of FIG. 12.

In operation of the bottom stop applying, gapping and cutting mechanism 40, FIG. 1, the relay 718 of FIG. 23 is operated by temporarily closing the push button switch 730 to energize the winding of the relay 718 thus closing locking contacts 732 to lock the relay 718 in operated condition. Power is applied through the contacts 712, 714, and 716 of the relay 718 to the bottom stop machine 462. The relay 718 remains energized and the contacts 712, 714, 716 and 732 closed until the stop switch 728 is depressed by an operator or an overload in the bottom stop machine 462 is sensed by one or more of the sensors 720, 722 or 724.

In FIG. 25, relays 784 and 844 are energized by initially momentarily depressing push button start switch 822 to close contacts 842 and thus complete a circuit between line 744 and ground 162 through the windings of the relays 784 and 844. Operation of the relay 844 closes the locking or latching contacts 848 to maintain the relays 784 and 844 in an operated condition. Also, contacts 850 of relay 844 are opened while contacts 852 of relay 844 are closed to energize the relay 776 which in turn closes contacts 774. Contacts 782 and 818 of the relay 784 are held closed while contacts 790 and 828 of the relay 784 are held open. The relays 784, 844 and 776 remain operated or energized until stop push button switch 794 is depressed.

With the member or ram 468 (FIG. 1) and the punch assembly 464 in the raised position, the upper limit switch 706 is operated to connect the normally opened contact of switch 706 to ground 162. Thus the time delay relay 814 is operated causing contacts 812 and 824 thereof to be closed and contacts 832 to be opened. During the momentary depression of the start switch 822, contacts 834 are closed to place a charge across the capacitance 826. Then when the start switch 822 is released contacts 820 close completing a path from the capacitance 826 through contacts 824, 820 and 818 and resistance 816 to the gate electrode of SCR 802 rendering the SCR 802 conductive to complete a circuit through the clutch 422 to operate the clutch 422. The rendering of the SCR 802 electrically connects one side of the capacitance 810 through SCR 802 to ground line 162 which causes the anode of SCR 788 to temporarily go negative rendering the SCR 788 non-conductive to deenergize the brake 418.

Referring to FIG. 2, the operation of the clutch 422 and the deenergization of the brake 418 drives the shaft 424, the chain 426, the shaft 428 and the clutch 430 to rotate the shaft 431 (FIGS. 11 and 12) and drive wheel 432 to push the slide fastener chain 48 and attached flypieces 46 between the guide members 450 and 452 into the base unit 458. The coupling elements 54 of the slide fastener chain 48 are guided in the passageway formed by grooves 454 and 456 between members 450 and 452. Since the members 452 and 450 extend from the exit between the wheel 432 and the roller 442 and since the grooves 454 and 456 form a passageway confining the coupling elements 54 to a generally straight line from the drive wheel 432 to the entrance formed by ridges 666, 668 and 672 and shoulder 670 in the base unit 458 of FIG. 17, the coupling elements are pushed into the base unit 458 directly over the anvil 488. From the anvil 488, the elements 54 are pushed through a passageway formed by the ridges 674 and 676 on the die 486, a ridge 678 in FIG. 19 on the cover 638, and the right edge of movable plate 680.

The slide fastener elements 54 are relatively incompressible in the longitudinal direction of the slide fastener chain 48 and are easily pushed while confined in a passageway to thus push the slide fastener chain 48 and attached flypieces 46 into and through the base unit 458.

The feeding of the slide fastener chain 48 and the folded and attached flypieces 46 continues until the gap 194, FIG. 3, between successive flypieces 46 reaches a position between the opening 702 in the die 486 and the bottom of the fiber optic tube 694 whereupon the change in reflected light sensed by light sensitive diode 761 of sensor 704 (FIG. 25) operates the sensing circuit and relay unit 760 to open contacts 764 and close contacts 766 and 768. The closing of the contacts 768 completes a circuit from line 744 through contacts 768, contacts 782 and the resistance 786 to the gate electrode of SCR 788 to render the SCR 788 conductive. SCR 788 completes a circuit path for the brake 418 from the voltage line 752 through the parallel combination of resistance 796 and capacitance 794, the brake 418, SCR 788 and the contacts 792 of the switch 794 to ground line 162 to operate the brake 418. The capacitance 798 initially adds to the current through the brake 418 to thus produce a higher energizing current through the brake to insure rapid operation; thereafter the capacitance 798 does not contribute to the current through the brake 418 but rather the brake 418 remains energized by current through resistance 796 to maintain the brake 418 operative. When SCR 788 is rendered conductive, the side of capacitance 810 corrected to SCR 788 is connected to ground 162. The charge on capacitance 810, previously made when SCR 788 was conductive and SCR 802 conductive, forces the anode of SCR 802 negative to stop conduction through the SCR 802. This results in the clutch 422 becoming deenergized. With the clutch 422 deenergized and the brake 418 operated, the feeding of the slide fastener chain 48 into the base unit 458 stops. The opening of contacts 764 disconnects the charging circuit for capacitance 772; and the closing of contacts 766 connects the capacitance 772, previously charged through the contacts 764 and the resistance 770, through previously closed contacts 774 to the advance solenoid 778 of valve 758. The charge on capacitance 772 operates the valve 758 causing the air cylinder 474, FIG. 1, to advance the piston rod 472. This operates the toggle links 470 and 478 to drive the shafts 466 and 467 downward pulling the punch assembly 464 downward. Inertia and inherent delay in operating the brake 418 and the clutch 422 during stopping of the feeding of the slide fastener chain 48 and attached flypieces results in movement of the gap 194 between flypieces past the optic tube 694 and into alignment with the die slot 630. The sensing circuit and relay unit 760 opens contacts 766 and 768 and closes the contacts 764; however, the valve 758 remains in the operated condition to continue advancement of piston rod 472 of the air cylinder 474.

Downward movement of the member 468 and shafts 466 and 467 of FIG. 1 results in disengagement of the limit switch 706 disconnecting contact arm thereof, FIG. 25, from the normally open contact of the switch 706 which disconnects the ground line 162 from SCR 802 insuring the breaking of the circuit path through SCR 802 and the clutch 422 while the punch assembly 464 is below the fully raised position. Also the disconnection of the normally closed contact of switch 706 from the ground line 162 deenergizes the time delay relay 814 closing the contacts 832 and opening contacts 812 and 824 thereof.

Downward movement of the punch assembly 464, FIGS. 17 and 19, engages the camming surface 626 with the surface 690 of the slidable plate 680 to move the plate 680 to the right and thus bring the right edge of the plate 680 into engagement with the fastening elements 54 to firmly and securely hold the fastening elements within the narrow passageway defined by ridges 674 and 676 of die 486 and ridge 678 on the right cover 638. Subsequently the fastener element locating members 546 and 548 engage the elements 54 as shown in FIGS. 20 and 21 to locate the fastening elements 54 with respect to the front and back edges of the gapping punch blade 554. The tips 610 of the locating member 548 move toward the rear upon this engagement by angled sliding movement of the member 548 within the recess 598 and slot 608. This rearward movement of the tip 610 ensures that the tip 610 will engage into an interstice between two adjacent fastening elements 54 and will then move the slide fastener chain 48 forward until the bottom edges of the blade portions 582 and 594 of the pressers pads 526, 528, 534 and 536 engage the elements 54; free forward movement of the slide fastener chain 48 is permitted by the one way clutch 430, FIG. 2, permitting free forward rotation of chain pushing wheel 432, FIG. 11. Continued downward movement of the punch assembly 464 engages the gapping punch blade 554 with the elements 54 shearing the center portion of the elements by means of the blade 554 cooperating with the die slot 632 to form the gaps 66 and 68, FIG. 3, in the slide fastenr chain 48. The locating members 546 and 548 insure that whole elements 54 are sheared, i.e., that the front and rear ends of the gapping punch 554 do not engage and shear only portions of an element. The tapes 50 and 52 of the slide fastener chain 48 are severed by means of the cutting blade 524 cooperating with the slot 630 in the die member 486 to shear a narrow slit 64, FIG. 3 thereacross.

During the downward movement of the punch assembly 464 and the block 468 of FIG. 1, the intermediate limit switch 708 is operated. Referring to FIG. 25, the operation of the switch 708 closes a circuit path from the voltage line 644 through relay 870, contacts 868 and the switch 702 to ground line 162 to close contacts 738 and 740 of relay 870 which triggers the operation of the bottom stop machine 462. The bottom stop machine 462 drives a staple-like bottom stop downward onto the fastening elements 54 overlying anvil 488 of FIGS. 17 and 18 to clinch the bottom stop 70, FIG. 1, on slide fastener chain 48. The chain 48 is accurately positioned at the front of the anvil 488 by means of the ridges 666 and 668 on the housing 480, the ridge 672 on the cover 638, and the shoulder 670 on the cover 636. At the rear of the anvil 488, the chain 48 is accurately held in position by the ridges 674 and 676 on the die member 486, the ridge 678 on the cover member 638, the right edge of the movable guide plate 680 as well as the blade portions of the pressers 526 and 528. The rear positioning and holding arrangement comprised of the ridges 674 and 676 on the die member 486, the ridge 678 on the cover member 638, the plate 680 and the pressers 526 and 528 cooperates with both the gapping blade 554 and the bottom stop applying machine 462 to ensure the accurate positioning of the elements 54 and prevent twisting or misalignment of the elements 54 during the gapping as well as during the application of a bottom stop.

When the punch assembly 464 reaches its lowermost position, the limit switch 710 is operated. As shown in FIG. 25 the operation of the switch 710 completes a circuit path from voltage line 744 through relays 856 and 860 as well as through the return solenoid 858 of the valve 758. The solenoid 858 operates the valve 758 to reverse the air inputs to the air cylinder 474 (FIG. 1) and produce the raising of the shafts 466 and 467 and the punch assembly 464. Operation of the relay 860 opens contacts 868 in series with the relay 870 to prevent triggering of the bottom stop machine 462 by relay 870 during upward movement of the punch assembly 464. The operation of the relay 856 closes contacts 866 which completes a latching circuit from line 744 through the parallel arrangement of the relays 856 and 860 and the solenoid winding 858, the contacts 866, normally closed contact of upper limit switch 706, and closed contacts 792 to ground line 162. Thus the relays 856 and 860 and the solenoid 858 remain energized until the punch assembly 464 returns to its uppermost position where the upper limit switch 706 is operated to disconnect the contact arm thereof from the closed contact of switch 706 to thus open the circuit path through the parallel arrangement of relays 856 and 860 and the solenoid 858.

When the punch assembly 464, shafts 466 and 468 and block 468 reach their upper position and the limit switch 706 is operated, the normally open contact of switch 706 is connected to the ground line 182 which thus energizes the time relay 814. After a duration determined by a time delay of the relay 814 the contacts 832 are opened and the contacts 812 and 824 of the time delay relay 814 are closed. Closing the contacts 824 completes a circuit from capacitance 826 through contacts 824, contacts 820, contacts 818 and resistance 816 to the gate electrodes of SCR 802. The charge on capacitance 826, previously charged through resistance 830 and contacts 832 while the relay 814 was unoperated, triggers SCR 802. This begins another cycle of feeding the slide fastener chain 48 with attached flypieces 46 into the base unit 458.

The slide fastener chain unit with attached flypiece severed at 64, FIG. 3, from the continuous slide fastener chain 48 is pulled from the base unit 464 of FIG. 1 by the pull wheel 874. The leading end of the continuous slide fastener chain 52 with attached flypieces will also be pulled by the wheel 874 after this leading edge has been pushed from the rear of the base unit 458 before gapping and cutting of the next section of slide fastener chain. The one way clutch 430, FIG. 2, permitting free forward rotation of the pushing wheel 432, FIG. 12, prevents any excessive tension on the slide fastener chain due to the pull wheel 874 pulling the chain 48 at a faster rate than the chain 48 is pushed by wheel 432.

During the raising of the punch assembly 464, the camming surface 628, FIG. 19, engages the surface 692 on the movable plate 680 moving the movable plate to the left. During the subsequent pushing of the new leading end of the continuous slide fastener chain 48 and attached folded flypieces 46 into the base unit 458, this retraction of the plate 680 to the left permits bottom stop 70 applied to such leading end to pass over the ridge 674 above the channel formed between ridges 674 and 676. Thus any hangup or restriction due to the stop 70 in the guide passages for the elements 54 to the rear of the anvil 488 is eliminated.

Automatic operation of the bottom stop applying, gapping and cutting mechanism 40 continues until the stop switch 794 is depressed, or the loop control switch 366 is operated by the loop becoming too short which deenergizes the motor 372 driving the slide fastener chain advancing wheel. Depression of the stop switch 794 to stop the mechanism 40 opens the contacts 840 to deenergize the relays 784, 844 and 776. The contacts 792 open to render both of the SCR's 788 and 802 non-conductive. Contacts 782 and 818 are opened by the relay 784 to disconnect the energizing circuits for SCR's 788 and 802 while contacts 790 and 828 are closed to connect the respective gate electrodes of the SCR's 788 and 802 to ground thus preventing operation of the SCR's 788 and 802. This insures that during stopping of the mechanism the brake 418 as well as the clutch 422 is unoperated. The relay 776 opens contacts 774 preventing any reenergization of the solenoid 778. If the solenoid 778 had been previously operated just prior to operation of the stop switch 794, the air cylinder 474 will continue to move downward until the limit switches 708 and 710 are operated to operate the bottom stop machine 462 and the return solenoid 858 of the valve 758 to cause the raising of the punch assembly 464. The mechanism 40 remains in this position until the start switch 822 is depressed to once again start the operation of the mechanism 40. Upon release of the stop switch 794, the contacts 792 close completing the circuit between the cathode of the SCR 788 and ground line 162.

Since many modifications changes in detail, and variations may be made in the present invention, it is intended that all matter in the foregoing description and shown in the accompanying drawings be interpreted as illustrative and not in a limiting sense.

What is claimed is:

1. A method of gapping and applying a bottom stop to a section of a slide fastener chain comprising advancing the section of slide fastener chain into a common base assembly extending beneath both a bottom stop applying machine and a gapping punch assembly which is adjacent to the bottom stop applying machine, lowering the gapping punch assembly, positioning and clamping the section of slide fastener chain in the base assembly underneath the gapping punch assembly during the lowering of the gapping punch assembly so as to also position and hold the slide fastener chain with respect to the bottom stop applying machine, said positioning and clamping including moving a positioning member transverse to the longitudinal dimension of the slide fastener chain from a retracted position to an advanced position to position fastening elements of the section of slide fastener chain within a channel extending in the common base, gapping the slide fastener chain by engaging a gapping punch in the gapping punch assembly with a selected number of fastening elements in the section of slide fastener chain during the lowering of the punch assembly but after the positioning and clamping of the section of slide fastener chain, applying a bottom stop to the section of slide fastener chain after the positioning and clamping of the section of slide fastener chain, raising the gapping punch assembly, retracting the positioning member after the gapping and applying a bottom stop, removing the section of slide fastener chain from the base assembly after the gapping and the applying of the bottom stop, and said retracting of the positioning member permitting the bottom stop to pass freely over the channel.

2. A method as claimed in claim 1 wherein the moving and retracting of the positioning member includes engaging a cam member extending downward from the gapping punch assembly with the positioning member during the lowering and raising of the gapping punch assembly to cam the positioning member from the retracted position to the advanced position and from the advanced position to the retracted position.

3. A method as claimed in claim 1 or 2 wherein the positioning and clamping includes engaging spring biased pressure pads in the gapping punch assembly with fastener elements in the section of slide fastener chain to hold the fastening elements of the section of slide fastener elements within the channel extending in the common base assembly.

4. A method as claimed in claim 1 or 2 wherein the slide fastener chain is a continuous slide fastener chain, and wherein the advancing of the section of slide fastener chain into the base assembly includes pushing the forward end of the continuous slide fastener chain over the common base assembly;

there is also included severing of the forward end portion from the continuous slide fastener chain by engaging a severing blade in the gapping punch assembly with the slide fastener chain during the lowering of the punch assembly but after the positioning and clamping of the section of slide fastener chain; and the removing of the section of slide fastener chain includes pulling the severed forward end portion from the base assembly after the gapping, the applying a bottom stop and the severing.

5. A method as claimed in claim 1 wherein the slide fastener chain is a continuous slide fastener chain, and wherein the advancing of the section of slide fastener chain includes pushing of the forward end of the continuous slide fastener chain first over an anvil portion of the common base assembly unit and then over a gapping and cutting portion of the common base assembly unit;

the moving the positioning member includes moving the positioning member parallel a plane of the tapes of the slide fastener chain over one of the tapes to position and secure fastening elements of the section of slide fastener chain within the channel extending in the gapping and cutting portion of the common base assembly under the slide fastener chain, and engaging spring biased pressure pads on the gapping punch assembly with fastening elements in the channel;

there is included severing a forward end portion of the slide fastener chain by means of engaging a severing blade in the gapping punch assembly with the slide fastener chain in the gapping and cutting portion of the common base assembly during the lowering of the punch assembly but after the positioning and clamping of the section of slide fastener chain; and the removing of the section of slide fastener chain includes pulling of the severed forward end portion from the base assembly;

said pushing of the section of slide fastener chain including pushing of a previously applied bottom stop on the forward end of the continuous slide fastener chain portion over the channel and out of the base assembly.

* * * * *